US011913462B2

(12) United States Patent
Huang et al.

(10) Patent No.: US 11,913,462 B2
(45) Date of Patent: Feb. 27, 2024

(54) MANUAL INFLATION AND DEFLATION ADJUSTMENT STRUCTURE FOR A PUMP

(71) Applicant: Intex Marketing Ltd., Tortola (VG)

(72) Inventors: Zhi Xiong Huang, Fujian (CN); Feng Chen, Fujian (CN); Huai Tian Wang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 3 days.

(21) Appl. No.: 18/073,235

(22) Filed: Dec. 1, 2022

(65) Prior Publication Data

US 2023/0093808 A1 Mar. 30, 2023

Related U.S. Application Data

(62) Division of application No. 16/767,371, filed as application No. PCT/IB2018/059367 on Nov. 27, 2018, now Pat. No. 11,549,514.

(30) Foreign Application Priority Data

Nov. 27, 2017 (CN) ..... 201721608434.5
Nov. 27, 2017 (CN) ..... 201721608664.1
Feb. 7, 2018 (CN) ..... 201820222184.X

(51) Int. Cl.
*F04D 25/12* (2006.01)
*A47C 27/08* (2006.01)
(Continued)

(52) U.S. Cl.
CPC ..... *F04D 25/12* (2013.01); *A47C 27/082* (2013.01); *F04D 25/084* (2013.01); *F04D 27/005* (2013.01); *F04D 29/4226* (2013.01)

(58) Field of Classification Search
CPC ..... F04D 25/12; F04D 27/005; F04D 29/4226
See application file for complete search history.

(56) References Cited

U.S. PATENT DOCUMENTS 388,037 A 8/1888 Hargin
1,198,687 A 9/1916 Williams et al.
(Continued)

FOREIGN PATENT DOCUMENTS

CN 1490529 A 4/2004
CN 2611641 Y 4/2004
(Continued)

OTHER PUBLICATIONS

International Preliminary Report on Patentability received for PCT Patent Application No. PCT/IB2016/001484, dated Apr. 26, 2018, 7 pages.
(Continued)

*Primary Examiner* — Brian O Peters
(74) *Attorney, Agent, or Firm* — Faegre Drinker Biddle & Reath LLP

(57) ABSTRACT

The present disclosure relates to air assemblies having an inflation, a deflation, and a closed state for use with inflatable products, such as air mattresses. Specifically, the present disclosure relates to air assemblies where the configuration of the air assembly can be changed manually by a user by operating a directional control valve to inflate, deflate, or close the inflatable product. The directional control valve may also activate a pump in the inflation and deflation states and deactivate the pump in the closed state.

11 Claims, 41 Drawing Sheets

(51) Int. Cl.

| | |
|---|---|
| ***F04D 25/08*** | (2006.01) |
| ***F04D 27/00*** | (2006.01) |
| ***F04D 29/42*** | (2006.01) |

(56) References Cited

U.S. PATENT DOCUMENTS

| | | | |
|---|---|---|---|
| 2,684,860 | A | 7/1954 | Rafferty |
| 2,926,836 | A | 3/1960 | Oliver et al. |
| 3,155,991 | A | 11/1964 | Dunham |
| 3,185,503 | A | 5/1965 | Angle |
| 3,388,701 | A | 6/1968 | Peter et al. |
| 3,596,936 | A | 8/1971 | Dieckmann et al. |
| 3,876,234 | A | 4/1975 | Harms |
| 4,193,149 | A | 3/1980 | Welch |
| 4,504,989 | A | 3/1985 | Maltz |
| 4,583,255 | A | 4/1986 | Mogaki et al. |
| 4,619,481 | A | 10/1986 | Grudzinskas |
| 4,638,519 | A | 1/1987 | Hess |
| 4,644,597 | A | 2/1987 | Walker |
| 4,711,275 | A | 12/1987 | Ford et al. |
| 4,768,249 | A | 9/1988 | Goodwin |
| 4,829,616 | A | 5/1989 | Walker |
| 4,890,344 | A | 1/1990 | Walker |
| 4,897,890 | A | 2/1990 | Walker |
| 4,944,060 | A | 7/1990 | Peery et al. |
| 5,009,252 | A | 4/1991 | Faughn |
| 5,020,176 | A | 6/1991 | Dotson |
| 5,023,967 | A | 6/1991 | Ferrand |
| 5,044,029 | A | 9/1991 | Vrzalik |
| 5,138,729 | A | 8/1992 | Ferrand |
| 5,142,717 | A | 9/1992 | Everard et al. |
| 5,189,742 | A | 3/1993 | Schild |
| 5,235,713 | A | 8/1993 | Guthrie et al. |
| 5,249,319 | A | 10/1993 | Higgs |
| 5,279,010 | A | 1/1994 | Ferrand et al. |
| 5,323,500 | A | 6/1994 | Roe et al. |
| 5,345,629 | A | 9/1994 | Ferrand |
| 5,349,983 | A | 9/1994 | Ozarowski et al. |
| 5,354,117 | A | 10/1994 | Danielson et al. |
| 5,367,726 | A | 11/1994 | Chaffee |
| 5,509,154 | A | 4/1996 | Shafer et al. |
| 5,588,811 | A | 12/1996 | Price |
| 5,606,756 | A | 3/1997 | Price |
| 5,652,484 | A | 7/1997 | Shafer et al. |
| 5,711,041 | A | 1/1998 | Chen |
| 5,716,199 | A | 2/1998 | Shan-Chieh |
| 5,802,640 | A | 9/1998 | Ferrand et al. |
| 5,898,958 | A | 5/1999 | Hall |
| 5,903,941 | A | 5/1999 | Shafer et al. |
| 5,904,172 | A | 5/1999 | Gifft et al. |
| 5,906,016 | A | 5/1999 | Ferrand et al. |
| 5,906,017 | A | 5/1999 | Ferrand et al. |
| 5,944,494 | A | 8/1999 | Soltani et al. |
| 5,970,550 | A | 10/1999 | Gazes |
| 6,032,080 | A | 2/2000 | Brisbane et al. |
| 6,037,723 | A | 3/2000 | Shafer et al. |
| 6,058,537 | A | 5/2000 | Larson |
| 6,120,264 | A | 9/2000 | Wang |
| 6,152,176 | A | 11/2000 | Lin |
| 6,158,082 | A | 12/2000 | Beckey et al. |
| 6,185,770 | B1 | 2/2001 | Wang |
| 6,206,654 | B1 | 3/2001 | Cassidy |
| 6,212,718 | B1 | 4/2001 | Stolpmann et al. |
| 6,219,868 | B1 | 4/2001 | Wang |
| 6,253,401 | B1 | 7/2001 | Boyd |
| 6,266,833 | B1 | 7/2001 | Lin |
| 6,332,760 | B1 | 12/2001 | Chung |
| 6,457,197 | B1 | 10/2002 | Wu |
| 6,483,264 | B1 | 11/2002 | Shafer et al. |
| 6,564,411 | B2 | 5/2003 | Pirzada |
| 6,571,825 | B2 | 6/2003 | Stacy |
| 6,581,223 | B1 | 6/2003 | Wang |
| 6,591,437 | B1 | 7/2003 | Phillips |
| 6,623,249 | B1 | 9/2003 | Rogers et al. |
| 6,679,686 | B2 | 1/2004 | Wang |
| 6,686,711 | B2 | 2/2004 | Rose et al. |
| 6,698,046 | B1 | 3/2004 | Wu |
| 6,709,246 | B2 | 3/2004 | Boyd |
| 6,718,584 | B2 | 4/2004 | Rabaiotti et al. |
| 6,722,306 | B1 | 4/2004 | Wang |
| 6,733,254 | B1 | 5/2004 | Yen |
| 6,754,925 | B1 | 6/2004 | Wang |
| 6,754,926 | B2 | 6/2004 | Wang |
| 6,755,208 | B2 | 6/2004 | Chaffee |
| 6,763,540 | B1 | 7/2004 | Wang |
| 6,763,541 | B2 | 7/2004 | Mahoney et al. |
| 6,793,469 | B2 | 9/2004 | Chung |
| 6,800,165 | B2 | 10/2004 | Wang |
| 6,832,629 | B2 | 12/2004 | Wu |
| 6,832,630 | B2 | 12/2004 | Wu |
| 6,928,681 | B1 | 8/2005 | Stacy |
| 6,990,700 | B2 | 1/2006 | Chung |
| 7,020,921 | B2 | 4/2006 | Wang |
| 7,028,358 | B2 | 4/2006 | Liu |
| 7,036,171 | B2 | 5/2006 | Wu |
| 7,040,347 | B2 | 5/2006 | Wang |
| 7,089,618 | B1 | 8/2006 | Metzger |
| 7,114,204 | B2 | 10/2006 | Patrick |
| 7,114,207 | B2 | 10/2006 | Wang |
| 7,120,955 | B2 | 10/2006 | Wang |
| 7,128,525 | B2 | 10/2006 | Tsai |
| RE39,408 | E | 11/2006 | Wang |
| 7,131,701 | B1 | 11/2006 | Yang |
| 7,141,101 | B2 | 11/2006 | Amann |
| 7,152,265 | B2 | 12/2006 | Chung |
| 7,198,076 | B2 | 4/2007 | Wu |
| 7,210,902 | B2 | 5/2007 | Song et al. |
| 7,225,488 | B2 | 6/2007 | Wu |
| 7,232,376 | B2 | 6/2007 | Droppleman |
| 7,246,394 | B2 | 7/2007 | Wang |
| 7,284,291 | B2 | 10/2007 | Wang |
| 7,284,968 | B2 | 10/2007 | Tsai |
| 7,306,694 | B2 | 12/2007 | Wang |
| 7,313,837 | B2 | 1/2008 | Wang |
| 7,322,801 | B2 | 1/2008 | Li et al. |
| 7,334,274 | B2 | 2/2008 | Wang |
| 7,346,944 | B2 | 3/2008 | Shaw |
| 7,346,950 | B2 | 3/2008 | Chung |
| 7,365,277 | B2 | 4/2008 | Wang |
| 7,380,301 | B2 | 6/2008 | Chung |
| 7,387,290 | B2 | 6/2008 | Wang |
| 7,406,736 | B2 | 8/2008 | Flick |
| 7,426,766 | B2 | 9/2008 | Gammons |
| 7,434,283 | B2 | 10/2008 | Wilkinson et al. |
| 7,444,704 | B2 | 11/2008 | Phillips et al. |
| 7,475,443 | B2 | 1/2009 | Wang |
| 7,497,416 | B2 | 3/2009 | Wang |
| 7,509,698 | B2 | 3/2009 | Poulos |
| 7,571,500 | B2 | 8/2009 | Wu |
| 7,587,776 | B2 | 9/2009 | Poulos |
| 7,588,425 | B2 | 9/2009 | Chung |
| 7,597,123 | B2 | 10/2009 | Wang |
| 7,647,662 | B2 | 1/2010 | Wang |
| 7,648,392 | B2 | 1/2010 | Chambers et al. |
| 7,703,160 | B2 | 4/2010 | Wang |
| 7,735,164 | B1 | 6/2010 | Patrick |
| 7,739,760 | B2 | 6/2010 | Wang et al. |
| 7,739,763 | B2 | 6/2010 | Wang et al. |
| 7,784,131 | B2 | 8/2010 | Genaro et al. |
| 7,784,132 | B2 | 8/2010 | Gonzalez et al. |
| 7,789,194 | B2 | 9/2010 | Lathrop et al. |
| 7,805,785 | B2 | 10/2010 | Rawls-Meehan |
| 7,877,829 | B2 | 2/2011 | Gonzalez et al. |
| 7,886,386 | B2 | 2/2011 | Balonick et al. |
| 7,922,461 | B2 | 4/2011 | Wang |
| RE42,559 | E | 7/2011 | Wang |
| 7,979,169 | B2 | 7/2011 | Martin |
| 8,024,830 | B2 | 9/2011 | Wang et al. |
| 8,032,263 | B2 | 10/2011 | Rawls-Meehan |
| 8,032,960 | B2 | 10/2011 | Rawls-Meehan |
| 8,033,797 | B2 | 10/2011 | Kehrmann et al. |
| 8,033,800 | B2 | 10/2011 | Pan |
| 8,046,117 | B2 | 10/2011 | Rawls-Meehan |
| 8,051,517 | B2 | 11/2011 | Wang et al. |

(56) References Cited

U.S. PATENT DOCUMENTS

| | | | |
|---|---|---|---|
| 8,052,630 | B2 | 11/2011 | Kloecker et al. |
| 8,078,336 | B2 | 12/2011 | Rawls-Meehan |
| 8,078,337 | B2 | 12/2011 | Rawls-Meehan |
| 8,083,396 | B2 | 12/2011 | Wang |
| 8,087,113 | B2 | 1/2012 | Roff et al. |
| 8,104,126 | B2 | 1/2012 | Caminade et al. |
| 8,125,318 | B2 | 2/2012 | Heimbrock et al. |
| 8,151,390 | B2 | 4/2012 | Wang et al. |
| 8,156,589 | B2 | 4/2012 | Liu et al. |
| 8,157,535 | B2 | 4/2012 | Wang et al. |
| 8,162,009 | B2 | 4/2012 | Chaffee |
| 8,176,588 | B2 | 5/2012 | Lin |
| 8,192,298 | B2 | 6/2012 | Droppleman |
| 8,210,834 | B2 | 7/2012 | Tsai |
| 8,214,953 | B2 | 7/2012 | Wang |
| 8,216,290 | B2 | 7/2012 | Shawver et al. |
| 8,235,684 | B2 | 8/2012 | Song et al. |
| 8,276,222 | B1 | 10/2012 | Patrick |
| 8,297,309 | B2 | 10/2012 | Wang |
| 8,336,369 | B2 | 12/2012 | Mahoney |
| 8,348,207 | B2 | 1/2013 | Wang et al. |
| 8,413,278 | B2 | 4/2013 | Chaffee |
| 8,444,103 | B2 | 5/2013 | Wang et al. |
| 8,480,375 | B2 | 7/2013 | Tsai |
| 8,549,686 | B2 | 10/2013 | Wang et al. |
| 8,561,230 | B2 | 10/2013 | Shaw |
| 8,641,391 | B2 | 2/2014 | Pan |
| 8,646,812 | B2 | 2/2014 | Chien et al. |
| 8,656,539 | B1 | 2/2014 | Boyd |
| 8,678,007 | B2 | 3/2014 | Porter, III |
| 8,682,457 | B2 | 3/2014 | Rawls-Meehan |
| 8,696,322 | B2 | 4/2014 | Kehrmann et al. |
| 8,745,796 | B2 | 6/2014 | Liu |
| 8,769,747 | B2 | 7/2014 | Mahoney et al. |
| 8,801,392 | B2 | 8/2014 | Wang et al. |
| 8,832,886 | B2 | 9/2014 | Riley et al. |
| 8,839,473 | B1 | 9/2014 | Catala |
| 8,839,474 | B2 | 9/2014 | Chaffee |
| 8,863,771 | B2 | 10/2014 | Wang et al. |
| 8,887,326 | B2 | 11/2014 | Patrick |
| 8,893,339 | B2 | 11/2014 | Fleury et al. |
| 8,894,390 | B2 | 11/2014 | Hsu |
| 8,905,981 | B2 | 12/2014 | Budig et al. |
| 8,910,331 | B2 | 12/2014 | Wang et al. |
| 8,931,329 | B2 | 1/2015 | Mahoney |
| 8,966,689 | B2 | 3/2015 | McGuire et al. |
| 9,033,678 | B2 | 5/2015 | Tsai |
| 9,062,668 | B2 | 6/2015 | Wang et al. |
| 9,114,048 | B2 | 8/2015 | Takeda et al. |
| 9,121,519 | B2 | 9/2015 | Wang et al. |
| 9,125,777 | B2 | 9/2015 | Patrick |
| 9,127,798 | B2 | 9/2015 | Wu |
| 9,157,433 | B2 | 10/2015 | Wang et al. |
| 9,211,018 | B2 | 12/2015 | Wang |
| 9,211,019 | B2 | 12/2015 | Driscoll et al. |
| 9,241,580 | B2 | 1/2016 | Patrick et al. |
| 9,279,510 | B2 | 3/2016 | Chaffee |
| 9,289,073 | B2 | 3/2016 | Chaffee |
| 9,295,336 | B2 | 3/2016 | Driscoll et al. |
| 9,314,105 | B2 | 4/2016 | Martin |
| 9,314,388 | B2 | 4/2016 | Patrick |
| 9,364,386 | B2 | 6/2016 | Siegner |
| 9,371,828 | B2 | 6/2016 | Tsai |
| 9,371,837 | B2 | 6/2016 | Tsai |
| 9,395,076 | B2 | 7/2016 | Wang et al. |
| 9,541,096 | B2 | 1/2017 | Tsai |
| 9,719,541 | B2 | 8/2017 | De Grasse |
| 9,729,430 | B2 | 8/2017 | Weinstein |
| 9,848,706 | B2 | 12/2017 | Wang et al. |
| 9,879,682 | B1 | 1/2018 | Beliveau et al. |
| 9,913,547 | B2 | 3/2018 | Driscoll et al. |
| 9,989,979 | B2 | 6/2018 | Wang et al. |
| 10,104,967 | B2 | 10/2018 | Wang et al. |
| 10,443,602 | B2 | 10/2019 | Liu |
| 10,502,218 | B2 | 12/2019 | Liu |
| 10,808,710 | B2 | 10/2020 | Huang et al. |
| 10,837,452 | B2 | 11/2020 | Huang et al. |
| 10,851,795 | B2 | 12/2020 | Lin et al. |
| 10,851,796 | B2 | 12/2020 | Li |
| 11,549,514 | B2 | 1/2023 | Huang et al. |
| 11,668,310 | B2 | 6/2023 | Huang et al. |
| 2003/0159218 | A1 | 8/2003 | Lin et al. |
| 2005/0079010 | A1 | 4/2005 | Droppleman |
| 2005/0079077 | A1 | 4/2005 | Tsai et al. |
| 2006/0117488 | A1 | 6/2006 | Hiung et al. |
| 2006/0204361 | A1 | 9/2006 | Xie |
| 2006/0222535 | A1 | 10/2006 | Liu |
| 2007/0033738 | A1 | 2/2007 | Tu |
| 2008/0201857 | A1 | 8/2008 | Kelly |
| 2010/0247337 | A1* | 9/2010 | Tsai ..... F04D 29/602 417/423.1 |
| 2010/0247356 | A1 | 9/2010 | Tsai |
| 2011/0073202 | A1 | 3/2011 | Feingold et al. |
| 2011/0173758 | A1 | 7/2011 | Fontaine |
| 2011/0259449 | A1 | 10/2011 | Wang et al. |
| 2011/0284108 | A1 | 11/2011 | Wang et al. |
| 2011/0314612 | A1 | 12/2011 | Hsu |
| 2012/0133182 | A1 | 5/2012 | Chiu |
| 2012/0304391 | A1 | 12/2012 | Driscoll et al. |
| 2013/0134764 | A1 | 5/2013 | Groh |
| 2013/0230410 | A1 | 9/2013 | Tsai |
| 2014/0090176 | A1 | 4/2014 | Boyd |
| 2014/0188285 | A1 | 7/2014 | Rawls-Meehan |
| 2014/0205123 | A1 | 7/2014 | Lafort et al. |
| 2014/0250597 | A1 | 9/2014 | Chen et al. |
| 2014/0259434 | A1 | 9/2014 | Nunn et al. |
| 2014/0277611 | A1 | 9/2014 | Nunn et al. |
| 2014/0298589 | A1 | 10/2014 | Bailey |
| 2014/0366957 | A1 | 12/2014 | Wang et al. |
| 2015/0026896 | A1 | 1/2015 | Fleury et al. |
| 2015/0082547 | A1 | 3/2015 | Boyd |
| 2015/0082548 | A1 | 3/2015 | Boyd |
| 2015/0089748 | A1 | 4/2015 | Toms et al. |
| 2015/0135444 | A1 | 5/2015 | Spahn et al. |
| 2015/0157137 | A1 | 6/2015 | Nunn et al. |
| 2015/0164236 | A1 | 6/2015 | Driscoll et al. |
| 2015/0182033 | A1 | 7/2015 | Brosnan et al. |
| 2015/0265056 | A1 | 9/2015 | Wang et al. |
| 2015/0308454 | A1 | 10/2015 | Shi |
| 2015/0366368 | A1 | 12/2015 | Cheng |
| 2015/0374137 | A1 | 12/2015 | Mahoney et al. |
| 2016/0106620 | A1 | 4/2016 | Uno et al. |
| 2016/0120331 | A1 | 5/2016 | Wang et al. |
| 2016/0215780 | A1 | 7/2016 | Liu |
| 2016/0238000 | A1 | 8/2016 | Suarez |
| 2017/0130728 | A1 | 5/2017 | Feng |
| 2017/0156519 | A1 | 6/2017 | Cheng |
| 2017/0202364 | A1 | 7/2017 | Ohno et al. |
| 2017/0274396 | A1 | 9/2017 | Wang et al. |
| 2017/0280884 | A1 | 10/2017 | Liu |
| 2017/0292553 | A1 | 10/2017 | De Grasse |
| 2018/0335042 | A1 | 11/2018 | Lin et al. |
| 2019/0211829 | A1 | 7/2019 | Huang et al. |
| 2019/0301476 | A1 | 10/2019 | Huang et al. |
| 2020/0132083 | A1 | 4/2020 | Liu |
| 2020/0200180 | A1 | 6/2020 | Huang et al. |
| 2020/0256345 | A1 | 8/2020 | Huang et al. |
| 2020/0386235 | A1 | 12/2020 | Huang et al. |
| 2020/0386237 | A1 | 12/2020 | Huang et al. |
| 2020/0400149 | A1 | 12/2020 | Huang et al. |
| 2021/0003126 | A1 | 1/2021 | Huang et al. |
| 2021/0018013 | A1 | 1/2021 | Li |

FOREIGN PATENT DOCUMENTS

| | | | |
|---|---|---|---|
| CN | 2746161 | Y | 12/2005 |
| CN | 2750081 | Y | 1/2006 |
| CN | 1260478 | C | 6/2006 |
| CN | 1928419 | A | 3/2007 |
| CN | 201050491 | Y | 4/2008 |
| CN | 201090463 | Y | 7/2008 |
| CN | 201091399 | Y | 7/2008 |
| CN | 101310650 | A | 11/2008 |
| CN | 101439583 | A | 5/2009 |

(56) References Cited

FOREIGN PATENT DOCUMENTS

| | | | |
|---|---|---|---|
| CN | 201273290 | Y | 7/2009 |
| CN | 201347870 | Y | 11/2009 |
| CN | 102022364 | A | 4/2011 |
| CN | 201953695 | U | 8/2011 |
| CN | 103600502 | A | 2/2014 |
| CN | 104441637 | A | 3/2015 |
| CN | 105283098 | A | 1/2016 |
| CN | 205064308 | U | 3/2016 |
| CN | 205434304 | U | 8/2016 |
| CN | 105952663 | A | 9/2016 |
| CN | 205744550 | U | 11/2016 |
| CN | 107795517 | A | 3/2018 |
| CN | 207526720 | U | 6/2018 |
| CN | 207673622 | U | 7/2018 |
| CN | 208010629 | U | 10/2018 |
| CN | 208185017 | U | 12/2018 |
| DE | 1479712 | A1 | 7/1969 |
| DE | 202012002366 | U1 | 6/2012 |
| DE | 202014100140 | U1 | 4/2014 |
| DE | 202014102362 | U1 | 10/2014 |
| EP | 3059451 | A1 | 8/2016 |
| GB | 2428751 | A | 2/2007 |
| JP | 04-067428 | A | 3/1992 |
| JP | 05-084123 | A | 4/1993 |
| JP | 07-054781 | A | 2/1995 |
| JP | 2000-197672 | A | 7/2000 |
| JP | 3182060 | B2 | 7/2001 |
| JP | 2013-127206 | A | 6/2013 |
| JP | 5929157 | B2 | 6/2016 |
| SU | 268313 | A1 | 4/1970 |
| WO | 02/15835 | A1 | 2/2002 |
| WO | 2008/037136 | A1 | 4/2008 |
| WO | 2017/064553 | A1 | 4/2017 |

OTHER PUBLICATIONS

International Preliminary Report on Patentability received for PCT Patent Application No. PCT/IB2018/059009, dated May 28, 2020, 8 pgaes.

International Preliminary Report on Patentability received for PCT Patent Application No. PCT/IB2018/059367, dated Jun. 11, 2020, 7 pages.

International Search Report and Written Opinion received for PCT Patent Application No. PCT/IB2016/001484, dated Feb. 23, 2017, 8 pages.

International Search Report and Written Opinion received for PCT Patent Application No. PCT/IB2018/059009, dated Feb. 11, 2019, 10 pages.

International Search Report and Written Opinion received for PCT Patent Application No. PCT/IB2018/059367, dated Mar. 27, 2019, 10 pages.

Supplemental European Search Report in EP16855009 dated May 13, 2019, 9 pages.

Yingyi Motor, Micro Air Pump (2004), 4 pages, www.yingyimotor.com/product/60423125783-801366169/Micro_Air_Pump_YYP370_XB2_DC3V_6V_9V_12V_24V.html, Nov. 12, 2019.

* cited by examiner

MANUAL INFLATION AND DEFLATION ADJUSTMENT STRUCTURE FOR A PUMP

CROSS-REFERENCE TO RELATED APPLICATIONS

This application is a divisional of U.S. patent application Ser. No. 16/767,371, filed May 27, 2020, which is a national stage entry of International Patent Application No. PCT/M2018/059367, filed Nov. 27, 2018, which claims priority to Chinese Application Serial No. 201721608434.5, filed Nov. 27, 2017, Chinese Application Serial No. 201721608664.1, filed Nov. 27, 2017, and Chinese Application Serial No. 201820222184.X, filed Feb. 7, 2018, the disclosures of which are hereby expressly incorporated by reference herein in their entirety.

FIELD OF THE DISCLOSURE

The present disclosure relates to air assemblies having an inflation, a deflation, and a closed state for use with inflatable products, such as air mattresses.

BACKGROUND OF THE DISCLOSURE

Inflatable products are common in households due to the convenience of storage or transportation when such products are in a deflated state coupled with the utility of such products when in an inflated state. For example, air mattresses are often used in households both inside and outside of the home for activities such as camping or providing overnight guests with a bed. Air mattresses are generally provided with at least one inflatable air chamber and may be inflated or deflated using a built-in pump.

Many existing inflation and deflation pumps are constructed using a check valve and a directional control valve that coordinate with each other. Such pumps have complex structures, are relatively large, and come with relatively high production costs. As a result, pumps with less complexity and associated lower costs and smaller size are desired.

SUMMARY

The present disclosure relates to air assemblies having an inflation, a deflation, and a closed state for use with inflatable products, such as air mattresses. Specifically, the present disclosure relates to air assemblies where the configuration of the air assembly can be changed manually by a user by operating a directional control valve to inflate, deflate, or close an inflatable product. The directional control valve may also activate a pump in the inflation and deflation states and deactivate the pump in the closed state.

According an exemplary embodiment of the present disclosure, an air assembly is provided for use with an inflatable product, the air assembly including: a main body forming a main body chamber and further including at least one vent in communication with the inflatable product; a control panel coupled to the main body and further including a vent in communication with the surrounding environment and the main body chamber; an actuator disposed on the control panel; a transmission member coupled to the actuator and extending into the main body chamber; a pump body disposed in the main body chamber; a pump cover disposed in the main body chamber, the pump cover cooperating with the pump body to form an impeller chamber and further including an air inlet and an air outlet in communication with the impeller chamber; an impeller disposed within the impeller chamber; a motor disposed within the main body chamber and operably coupled to the impeller, the impeller configured to direct air from the air inlet to the air outlet of the pump cover; and a directional control valve coupled to the transmission member and disposed within the main body chamber, the directional control valve moveable between: a first position corresponding to an inflation state in which the directional control valve opens an airway between the air outlet of the pump cover and the at least one vent in the main body to inflate the inflatable product; a second position corresponding to a deflation state in which the directional control valve opens an airway between the air inlet of the pump cover and the at least one vent in the main body to deflate the inflatable product; and a third position corresponding to a closed state in which the directional control valve blocks airflow between the pump cover and the at least one vent in the main body to close the inflatable product.

According another exemplary embodiment of the present disclosure, an air assembly is provided for use with an inflatable product, the air assembly including: a main body forming a main body chamber with a first vent and a second vent in communication with the inflatable product; a control panel coupled to the main body and further including a vent in communication with the surrounding environment and the main body chamber; a rotating actuator disposed on the control panel; a transmission member coupled to the rotating actuator and extending into the main body chamber; a pump body disposed in the main body chamber; a pump cover disposed in the main body chamber, the pump cover cooperating with the pump body to form an impeller chamber and further including an air inlet and an air outlet in communication with the impeller chamber; an impeller disposed within the impeller chamber; a motor disposed within the main body chamber and operably coupled to the impeller, the impeller configured to direct air from the air inlet to the air outlet of the pump cover; and a directional control valve disposed within the main body chamber between the first vent and the second vent of the main body and the pump cover, the directional control valve driven by the transmission member and further including a plurality of vents for selective communication with the first vent and the second vent of the main body, the plurality of vents also in selective communication with the air inlet and the air outlet of the pump cover.

According another exemplary embodiment of the present discloser, an air assembly is provided for use with an inflatable product, the air assembly including: a main body forming a main body chamber with a vent in communication with the inflatable product; a control panel coupled to the main body and further including a vent in communication with the surrounding environment and the main body chamber; a rotating actuator disposed on the control panel; a pump body disposed in the main body chamber; a pump cover disposed in the main body chamber, the pump cover cooperating with the pump body to form an impeller chamber and further including an air inlet and an air outlet in communication with the impeller chamber; an impeller disposed within the impeller chamber; a motor disposed within the main body chamber and operably coupled to the impeller, the impeller configured to direct air from the air inlet to the air outlet of the pump cover; and a rotating directional control valve disposed within the main body chamber between the control panel and the pump cover, the rotating directional control valve further including: a first vent in communication with the vent of the control panel and in selective communication with the air inlet of the pump cover and the air outlet of the pump cover; and a second vent in communication with the vent of the main body and in selective communication with the air inlet of the pump cover and the air outlet of the pump cover.

According yet another exemplary embodiment of the present disclosure, an air assembly is provided for use with an inflatable product, the air assembly including: a main body forming a main body chamber with a vent in communication with the inflatable product; a control panel coupled to the main body and further including a vent in communication with the surrounding environment and the main body chamber; an actuator disposed on the control panel; a pump body disposed in the main body chamber; a pump cover disposed in the main body chamber, the pump cover cooperating with the pump body to form an impeller chamber and further including an air inlet and an air outlet in communication with the impeller chamber; an impeller disposed within the impeller chamber; a motor disposed within the main body chamber and operably coupled to the impeller, the impeller configured to direct air from the air inlet to the air outlet of the pump cover; and a translating directional control valve disposed within the main body chamber between the vent of the main body and the pump cover, the translating directional control valve further including a plurality of vents for selective communication with the vent of the main body and also in selective communication with the air inlet and the air outlet of the pump cover.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Referring generally to FIGS. 1-7, an air assembly 1000 is disclosed. Air assembly 1000 includes a main body 1011, which forms a main body chamber 1090 with an opening. At the lower end of the main body 1011 opposite the opening of the main body chamber 1090, the main body 1011 includes an air outlet 1112 that directs air to an inflatable product P and an air inlet 1111 that receives air from the inflatable product P, as shown in FIG. 4A, for inflation and deflation of the inflatable product P respectively. At the upper end of the main body 1011, a panel 1013 fits within the opening of the main body chamber 1090. A fixing ring 1014 removably couples the main body 1011 and the panel 1013 to a control panel 1012. The control panel 1012 may be welded, adhered, or otherwise attached to a wall of the inflatable product P.

Figure 1:
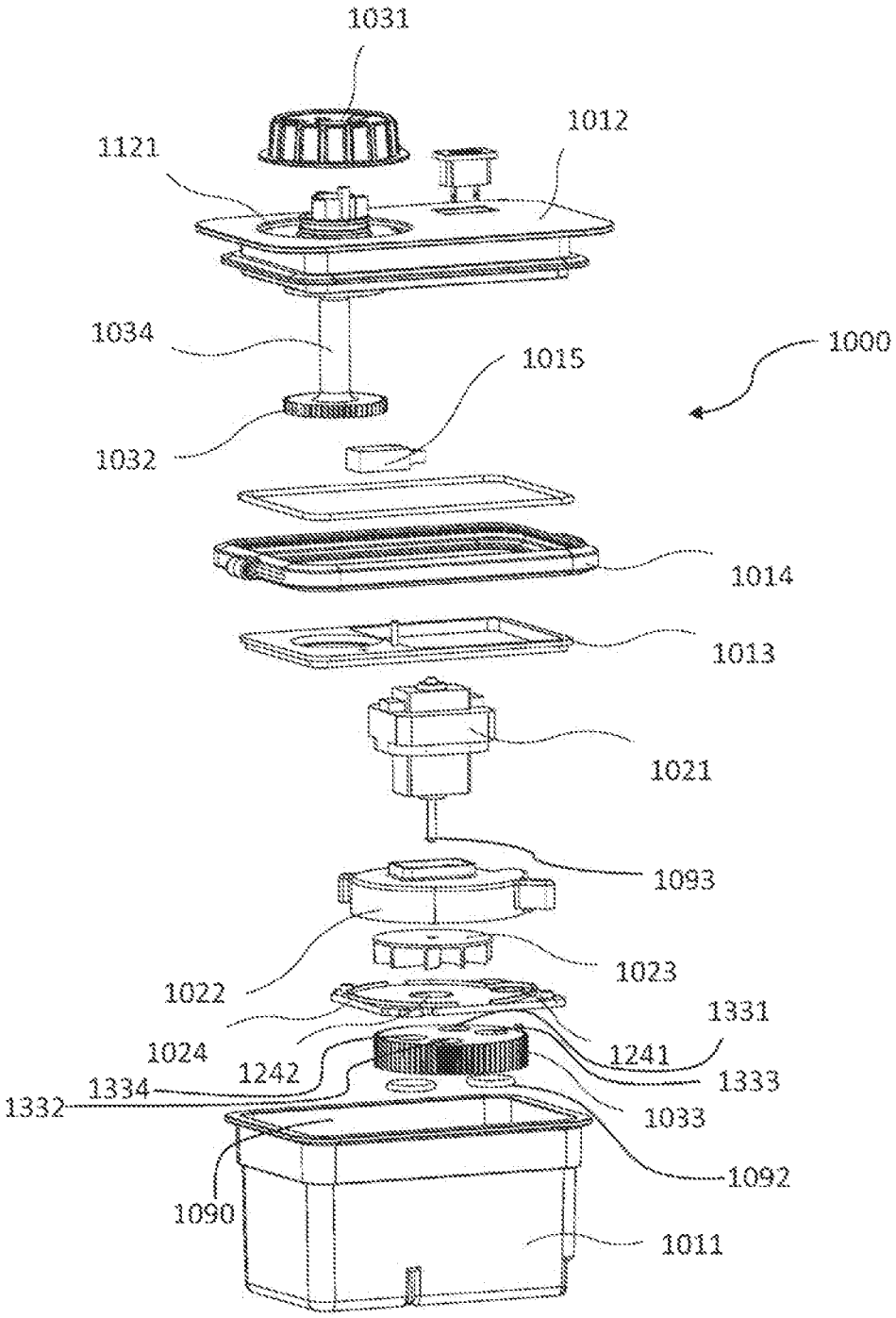
FIG. 1 illustrates an exploded, perspective view of an exemplary air assembly, including a main body, a control panel, and a rotating directional control valve.
Figure 2:
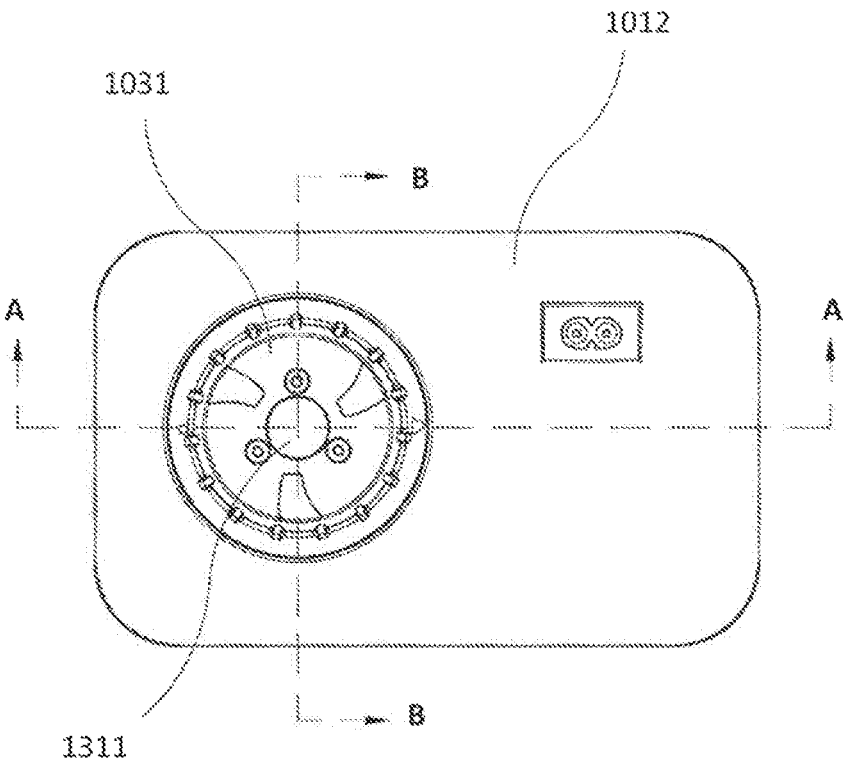
FIG. 2 illustrates is a top, plan view of the air assembly of FIG. 1, illustrating the control panel of the exemplary air assembly.
Figure 5:
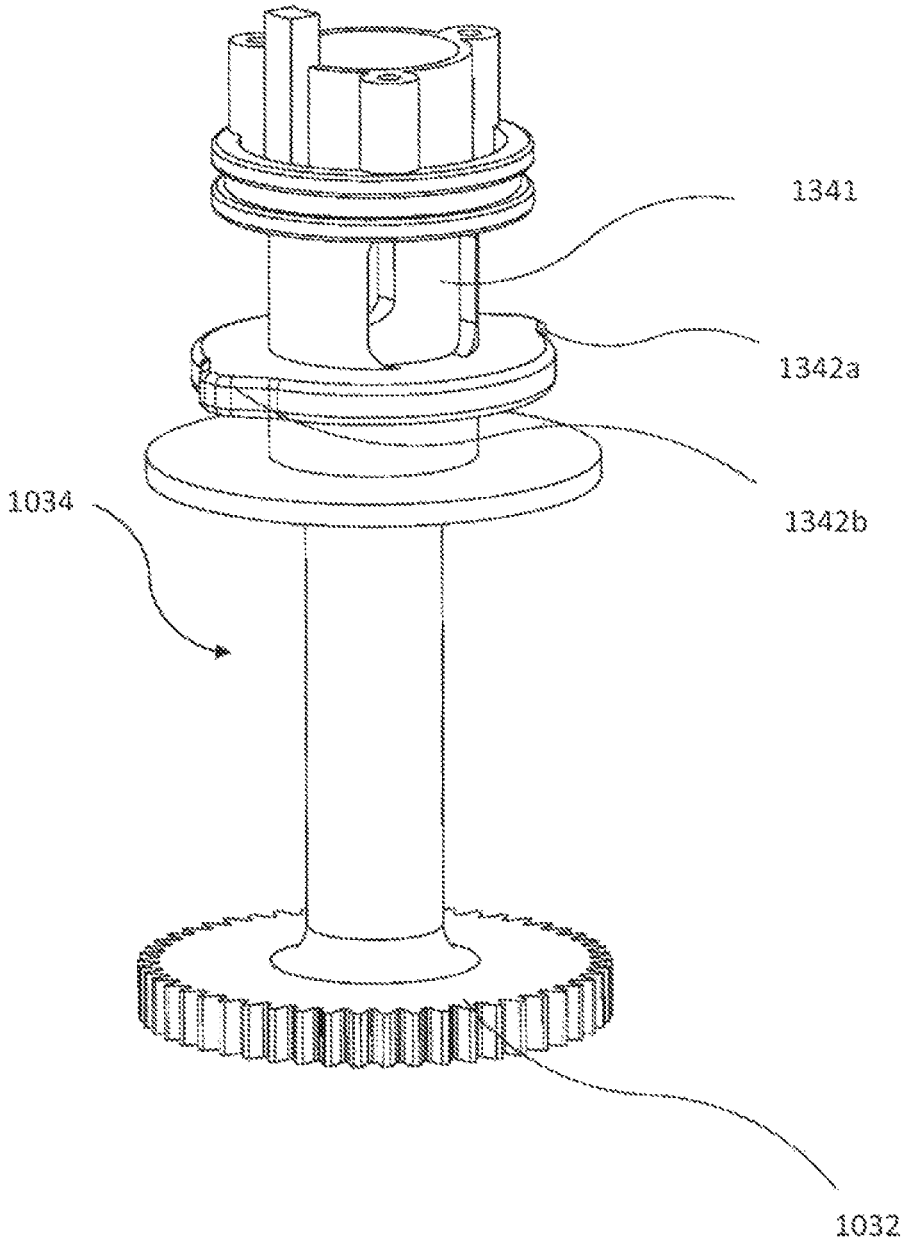
FIG. 5 illustrates a perspective view of a transmission member of the air assembly of FIG. 1.

Referring to FIGS. 1-2, the control panel 1012 includes a vent 1121 in communication with ambient air to facilitate the introduction of air into the air assembly 1000. A rotating actuator in the form of a hand wheel 1031 is positioned on the control panel 1012 over the vent 1121 and includes a wheel vent 1311. Referring also to FIG. 5, a transmission member in the form of a hollow rotating control shaft 1034 includes an upper portion coupled to the hand wheel 1031 above a top surface of the control panel 1012, a middle portion disposed through the control panel 1012, and a lower portion with a gear 1032 disposed within the main body chamber 1090. A sidewall of the rotating control shaft 1034 includes an air hole 1341, which places wheel vent 1311 in communication with main body chamber 1090 to enable the movement of ambient air into main body chamber 1090. The middle portion of the rotating control shaft 1034 is also disposed through panel 1013, which is coupled to an interior sidewall of the main body 1011 between the control panel 1012 and the gear 1032. The rotating control shaft 1034 includes sensed elements, such as protrusions 1342*a* and 1342*b* on its periphery (FIG. 5), configured for detection by a sensor, such as microswitch 1015 supported by panel 1013 and operably coupled to a power supply (not shown).

Figure 3:
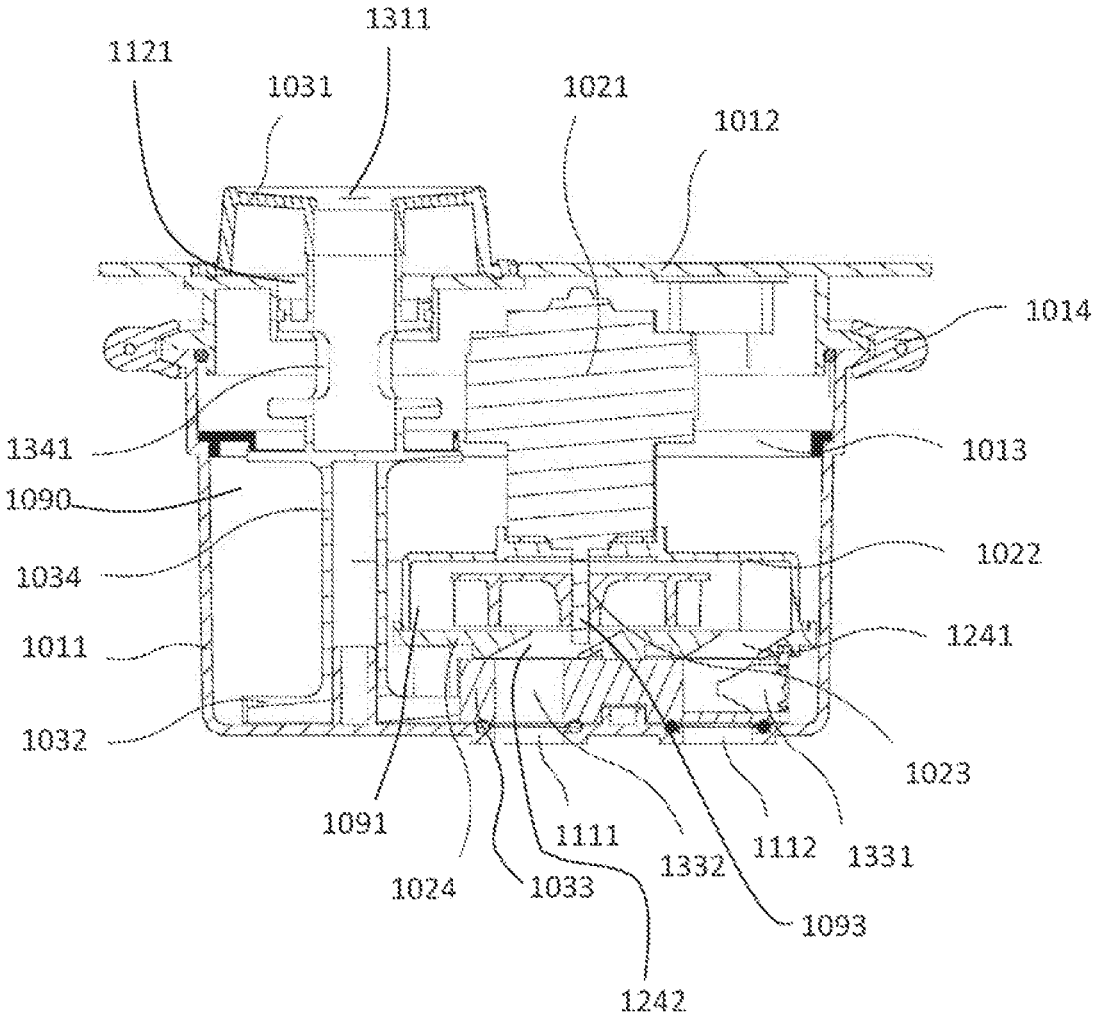
FIG. 3 illustrates a cross section view of the air assembly of FIG. 2, taken along the A-A line, illustrating the interior of the exemplary air assembly.
Figure 4:
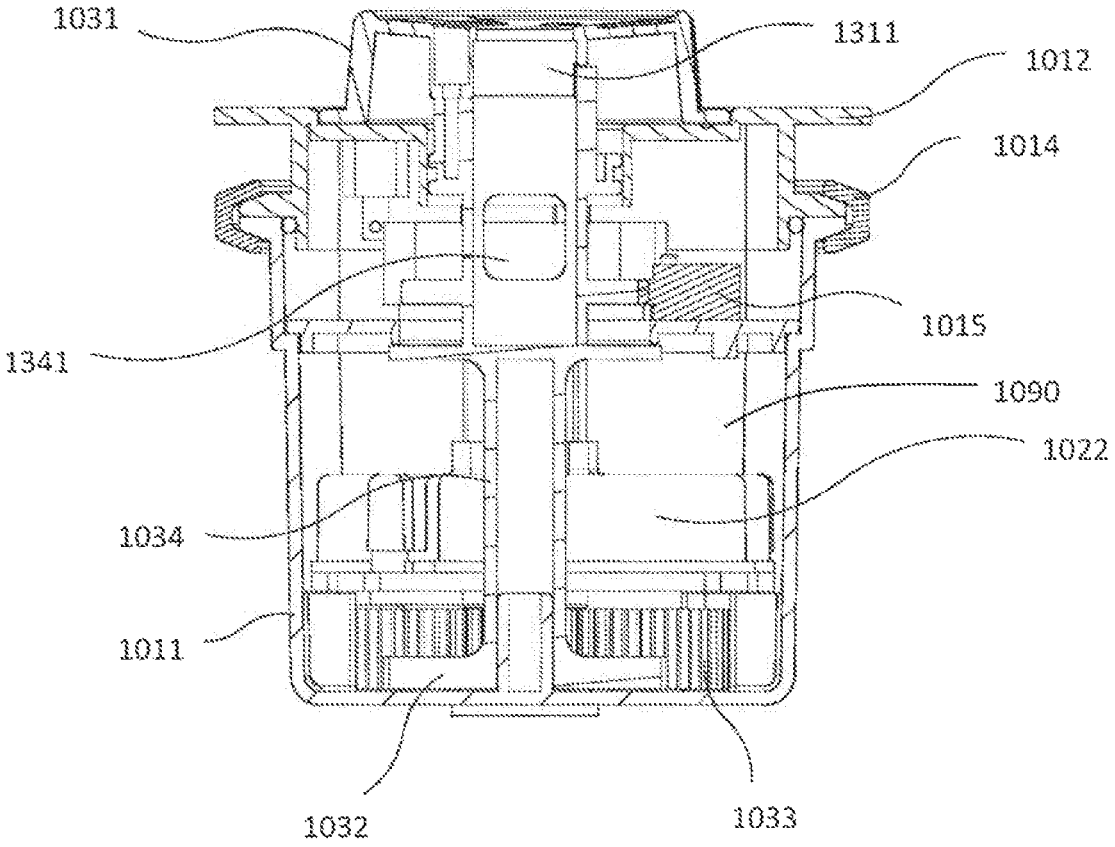
FIG. 4 illustrates a cross section view of the air assembly of FIG. 2, taken along the B-B line, illustrating the interior of the exemplary air assembly from another view.
Figure 4A:
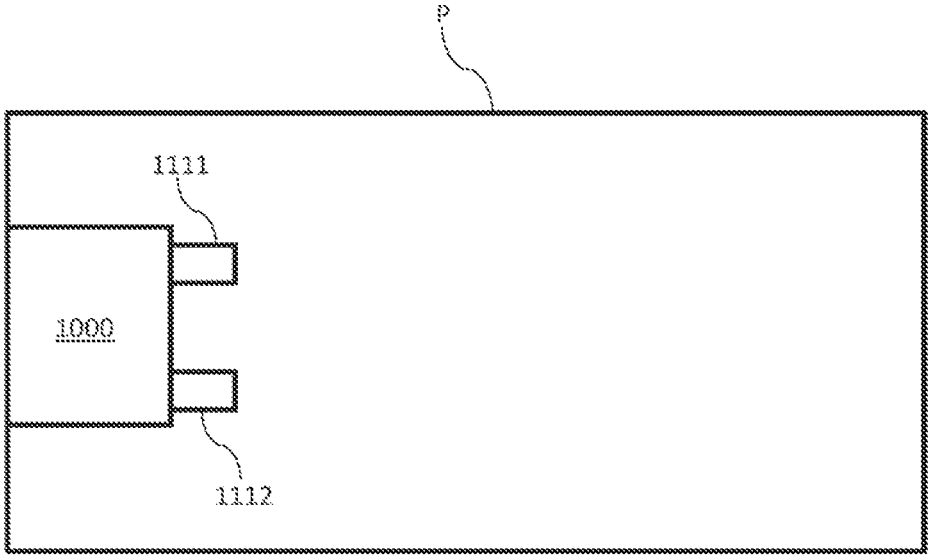
FIG. 4A illustrates a schematic view of the air assembly of FIG. 1 built into an inflatable product.

Referring now to FIGS. 1 and 3-4, a rotating directional control valve or disc 1033 is positioned within the main body chamber 1090 above the air inlet 1111 and the air outlet 1112 of the main body 1011 and engages with the gear 1032 so that the rotating disc 1033 rotates when the gear 1032 rotates. Gaskets 1092 (FIG. 1) are fitted within the air inlet 1111 and the air outlet 1112 to prevent the leakage of air before and after inflation or deflation of the inflatable product P (FIG. 4A). A pump cover 1024 is located within main body chamber 1090 and includes an air inlet 1241 in communication with the main body chamber 1090 and an air outlet 1242 in selective communication with the air inlet 1111 or the air outlet 1112 of the main body 1011. The pump cover 1024 cooperates with a pump body 1022 to form an impeller chamber 1091, which supports an impeller 1023. The impeller chamber 1091 is in communication with the main body chamber 1090 and in selective communication with air inlet 1111 or air outlet 1112 of the main body 1011 through air inlet 1241 and air outlet 1242 of the pump cover 1024 respectively. A motor 1021 is located above pump body 1022 within main body chamber 1090 and includes a rotational motor shaft 1093. The rotational motor shaft 1093 is disposed through the pump body 1022 to couple to the impeller 1023 within impeller chamber 1091 so that motor 1021 may drive the impeller 1023 to rotate to perform an inflation operation or a deflation operation.

Referring again to FIGS. 4 and 6-7, the rotating disc 1033 includes a first inlet vent 1331 to selectively communicate with the air inlet 1241 of the pump cover 1024 and the main body chamber 1090; a first outlet vent 1332 to selectively communicate with the air outlet 1242 of the pump cover 1024 and the air outlet 1112 of the main body 1011; a second air inlet vent 1333 to selectively communicate with the air inlet 1241 of the pump cover 1024 and the air inlet 1111 of the main body 1011; and a second air outlet vent 1334 to selectively communicate with the air outlet 1242 of the pump cover 1024 and the main body chamber 1090. The first inlet vent 1331 and the first outlet vent 1332 may be aligned across the rotating disc 1033 for simultaneous communication with the pump cover 1024 in an inflation state of FIG. 6, which is described further below. Similarly, the second inlet vent 1333 and the second outlet vent 1334 may be aligned across the rotating disc 1033 for simultaneous communication with the pump cover 1024 in a deflation state of FIG. 7, which is also described further below.

Returning to FIG. 2, the hand wheel 1031 may be rotated by a user to adjust the air assembly 1000 between the above-described inflation, deflation, and closed states. Illustratively, a rotation stroke of the hand wheel 1031 is about 120°, which coincides with an included angle between the two protrusions 1342*a* and 1342*b* on the rotating control shaft 1034 (FIG. 5). Specifically, a stroke angle between the inflation state and the closed state is about 60°, and a stroke angle from the closed state to the deflation state is about 60°. The angles between the corresponding vents 1331, 1332, 1333, and 1334 of the rotating disc 1033 also coincide. It is understood that these angles may vary.

In one configuration, when the air assembly 1000 is in a closed or non-operating state, first inlet vent 1331, first outlet vent 1332, second inlet vent 1333, and second outlet vent 1334 are offset from and not in communication with inflatable product P (FIG. 4A). In other words, the air inlet 1111 of the main body 1011 and the air outlet 1112 of the main body 1011 are closed and the gaskets 1092 create an air-tight seal between the rotating disc 1033, the air inlet 1111, and the air outlet 1112. When the hand wheel 1031 is in the closed state, neither of the protrusions 1342*a* or 1342*b* touch the microswitch 1015, so the motor 1021 may be disconnected from the power supply (not shown). In this closed state, the air inlet 1111 and the air outlet 1112 of the main body 1011 are closed, as described above.

Figure 6:
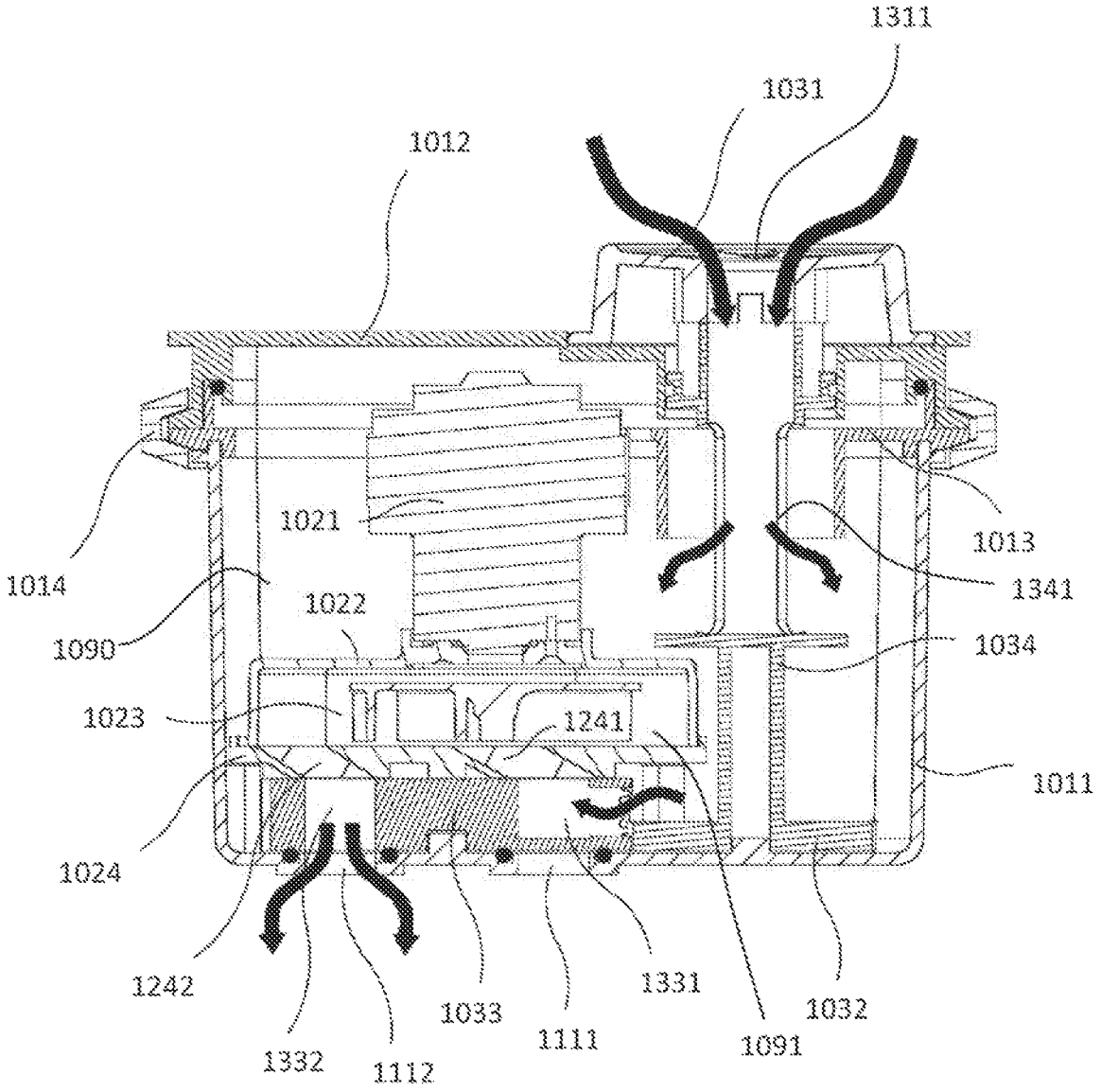
FIG. 6 illustrates a cross section view of the pump assembly of FIG. 1 in an inflation state, illustrating the path of air flow through the air assembly during inflation of an inflatable product.

In another configuration as shown by FIGS. 4 and 6, the L-shaped first inlet vent 1331 is in selective communication with the air inlet 1241 of the pump cover 1024 and the main body chamber 1090, and the first outlet vent 1332 is in selective communication with the air outlet 1242 of the pump cover 1024 and the air outlet 1112 of the main body 1011. In this configuration, the main body chamber 1090, the air inlet 1241 of the pump cover 1024, the impeller chamber 1091, the air outlet 1242 of the pump cover 1024, and the air outlet 1112 of the main body 1011 comprise an airway. The air inlet 1111, by contrast, is covered by the rotating disc 1033. Thus, the air outlet 1112 of the main body 1011 is opened and the air inlet 1111 of the main body 1011 is closed so that the inflatable product P (FIG. 4A) may be inflated. This configuration of air assembly 1000 may also be referred to as the inflation state.

As shown in FIG. 6, when a user rotates the hand wheel 1031 in a first direction by 60° to reach the inflation state, the gear 1032 rotates along with the hand wheel 1031 via rotating control shaft 1034 to engage rotating disc 1033. As a result, the air outlet 1112 of the main body 1011 is opened and the air inlet 1111 is closed as described above. Additionally, the first protrusion 1342*a* of the rotating control shaft 1034 touches the microswitch 1015 (FIG. 1), starting the motor 1021. Then, the motor 1021 drives the impeller 1023 to rotate, drawing ambient air into the main body chamber 1090 of the air assembly 1000 through the wheel vent 1311 of the hand wheel 1031 and the air hole 1341 of the rotating control shaft 1034. The air is then drawn into the impeller chamber 1091 through the first inlet vent 1331 of the rotating disc 1033 and the air inlet 1241 of the pump cover 1024. Then, the air moves through the impeller chamber 1091 and out of the air outlet 1242 of the pump cover 1024 and the first outlet vent 1332. The air is then free to exit through the air outlet 1112 of the main body 1011 and into the inflatable product P (FIG. 4A), thus inflating the inflatable product P.

Once the inflatable product P (FIG. 4A) has been inflated to a desired pressure, the user may rotate the hand wheel 1031 in the opposite direction by 60° back to the closed state, thereby turning the gear 1032 via rotating control shaft 1034 to engage with the rotating disc 1033 and close the air inlet 1111 and the air outlet 1112 of the main body 1011 as described above. Additionally, the protrusion 1342*a* no longer touches microswitch 1015 (FIG. 1), disconnecting the motor 1021 from the power supply (not shown) so that the motor 1021 stops operating.

Figure 7:
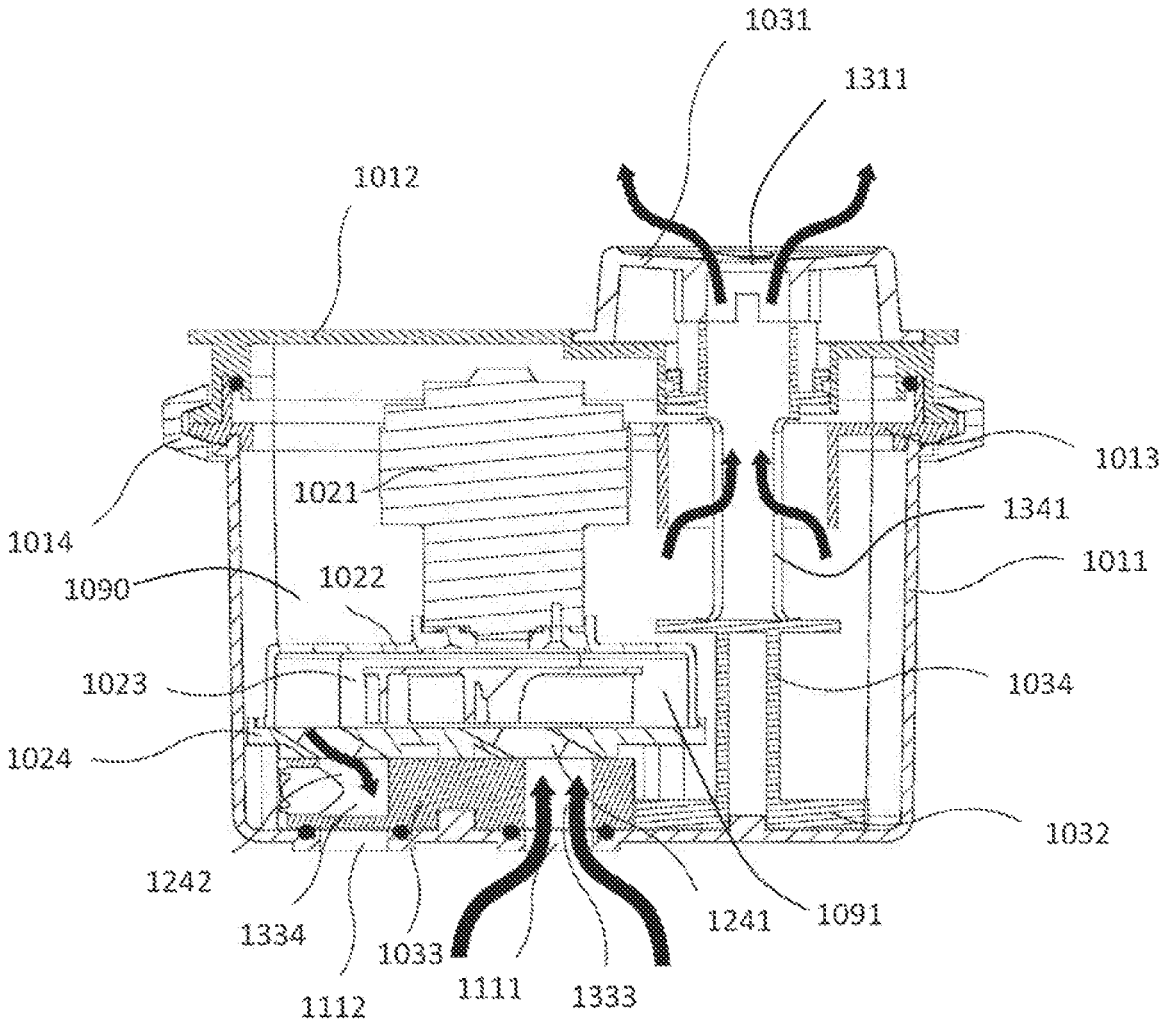
FIG. 7 illustrates a cross section view of the air assembly of FIG. 1 in a deflation state, illustrating the path of air flow through the air assembly during deflation of an inflatable product.

In another configuration as shown by FIG. 7, the second inlet vent 1333 is in selective communication with the air inlet 1241 of the pump cover 1024 and the air inlet 1111 of the main body 1011, and the L-shaped second outlet vent 1334 is in selective communication with the air outlet 1242 of the pump cover 1024 and the main body chamber 1090. In this configuration, the air inlet 1111 of the main body 1011, the air inlet 1241 of the pump cover 1024, the impeller chamber 1091, the air outlet 1242 of the pump cover 1024 and the main body chamber 1090 comprise an airway. The air outlet 1112, by contrast, is covered by the rotating disc 1033. Thus, the air inlet 1111 of the main body 1011 is opened and the air outlet 1112 of the main body 1011 is closed so that the inflatable product P (FIG. 4A) may be deflated. This configuration of air assembly 1000 may also be referred to as the deflation state.

As shown in FIG. 7, when a user rotates the hand wheel 1031 in a second direction by 60° to reach the deflation state, the gear 1032 rotates along with the hand wheel 1031 via rotating control shaft 1034 to engage rotating disc 1033. As a result, the air inlet 1111 of the main body 1011 is opened and the air outlet 1112 is closed as described above. Additionally, the second protrusion 1342*b* of the rotating control shaft 1034 touches the microswitch 1015 (FIG. 1), starting the motor 1021. Then, the motor 1021 drives the impeller 1023 to rotate, drawing air from the inflatable product P (FIG. 4A) into the main body chamber 1090 of the air assembly 1000 through the air inlet 1111 of the main body 1011. Specifically, the air is drawn in through air inlet 1111 of the main body 1011, through the second inlet vent 1333 of the rotating disc 1033, through the air inlet 1241 of the pump cover 1024, and then enters impeller chamber 1091. The air then moves through air outlet 1242 of the pump cover 1024 and the second outlet vent 1334 of the rotating disc 1033 into the main body chamber 1090. The air is then free to exit the air assembly 1000 into the surrounding environment through the air hole 1341 of the rotating control shaft 1034 and the wheel vent 1311 of the hand wheel 1031, thus deflating the inflatable product P.

Once the inflatable product P (FIG. 4A) has been deflated entirely or to a desired pressure, the user may rotate the hand wheel 1031 in the opposite direction by 60° back to the closed state, which closes the air inlet 1111 and the air outlet 1112 of the main body 1011 and turns off motor 1021 as described above.

Now referring to FIGS. 8-16, another embodiment of air assembly 2000 is disclosed. The air assembly 2000 has substantially the same structure and operation as the air assembly 1000, except as described below. Like elements of the air assembly 2000 are identified by adding "1000" to the corresponding reference number of the air assembly 1000.

Figure 8:
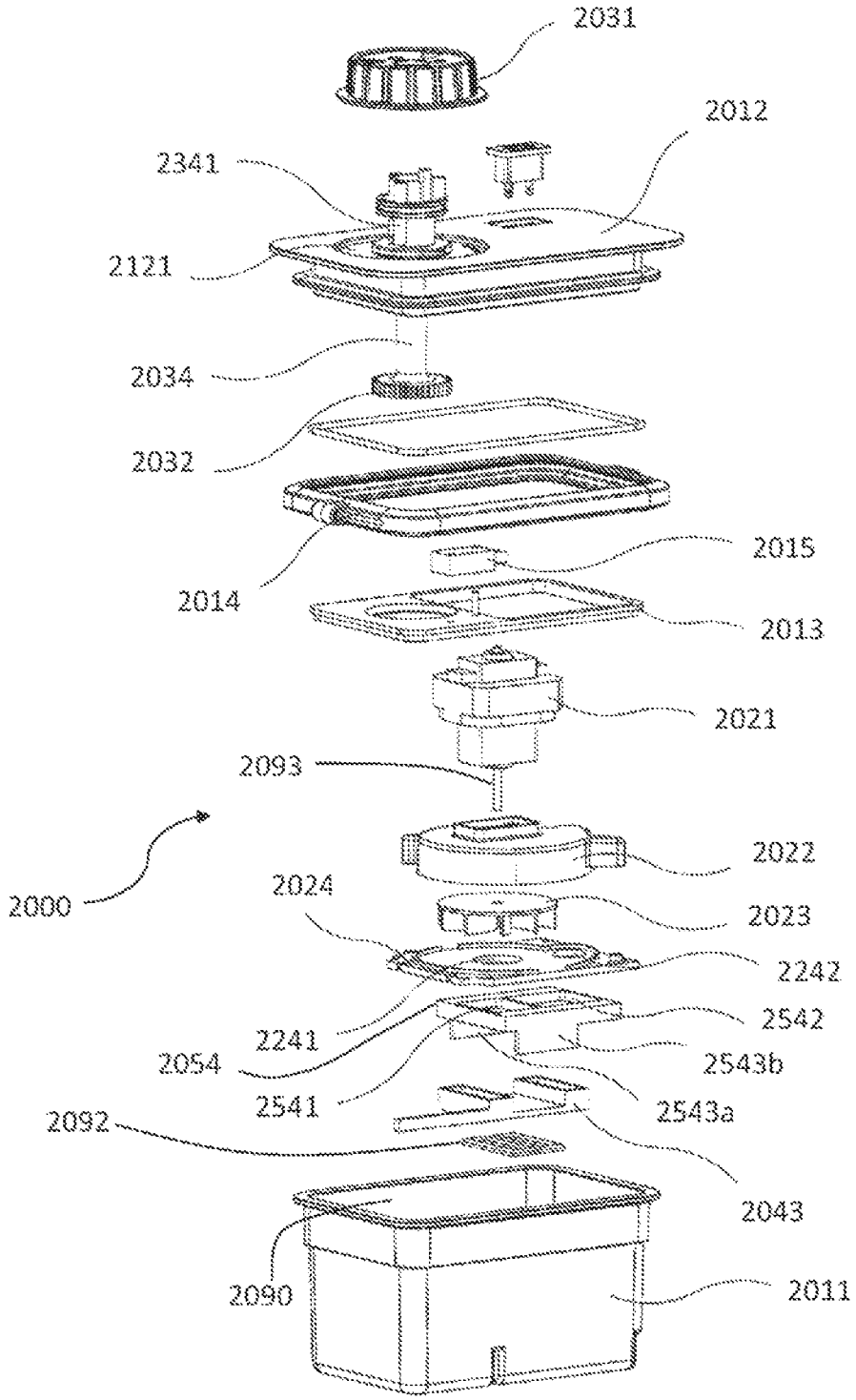
FIG. 8 illustrates an exploded, perspective view of a second exemplary air assembly, including a main body, a control panel, and a translating directional control valve.
Figure 9:
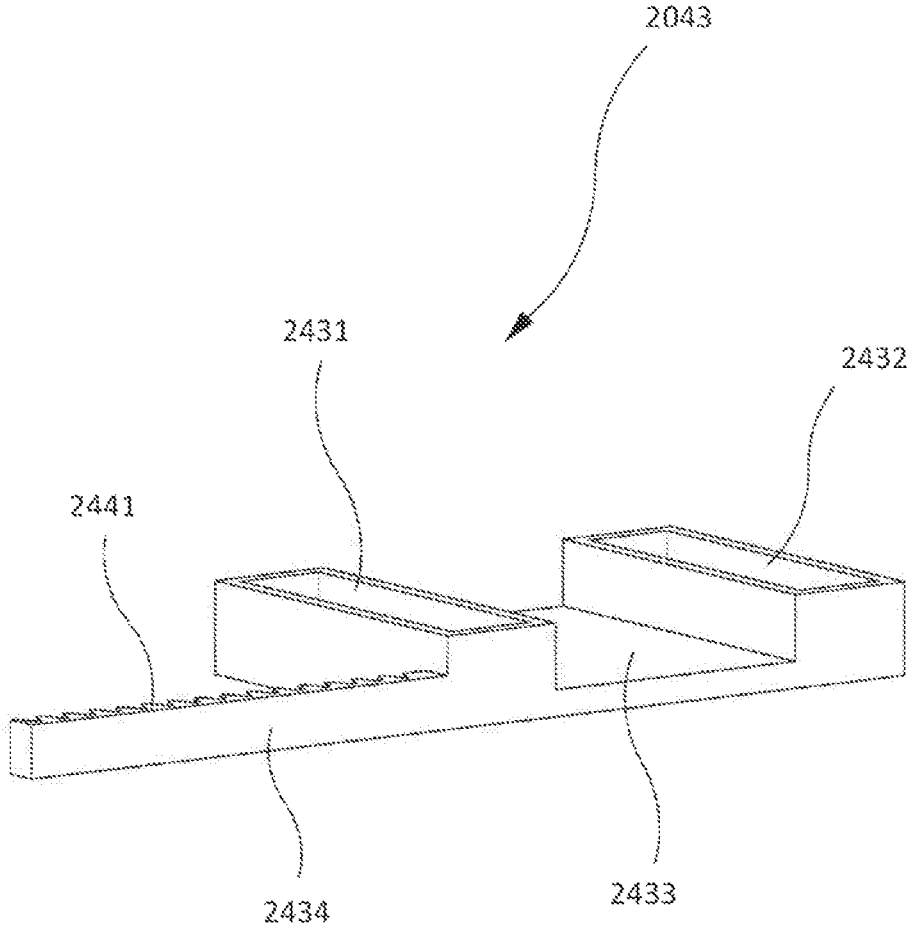
FIG. 9 illustrates a perspective view of a translating core of the air assembly of FIG. 8, illustrating the structure of the translating core.

Referring specifically to FIGS. 8-9, a translating directional control valve or core 2043 is positioned within the main body chamber 2090 above the air inlet 2111 and the air outlet 2112 of the main body 2011 (FIGS. 10-11) and engages with the gear 2032 so that the translating core 2043 translates side-to-side when the gear 2032 rotates. Gaskets 2092 are fitted between the translating core 2043, the air inlet 2111, and the air outlet 2112 to prevent the leakage of air before and after inflation or deflation of the inflatable product P (FIG. 4A). Specifically, as shown in FIG. 9 translating core 2043 includes a connecting arm 2434 with a rack 2441 to engage with the gear 2032 of the rotating control shaft 2034. As the rotating control shaft 2034 rotates, the gear 2032 rotates with the rotating control shaft 2034 and drives the translating core 2043 to translate side-to-side.

Figure 11:
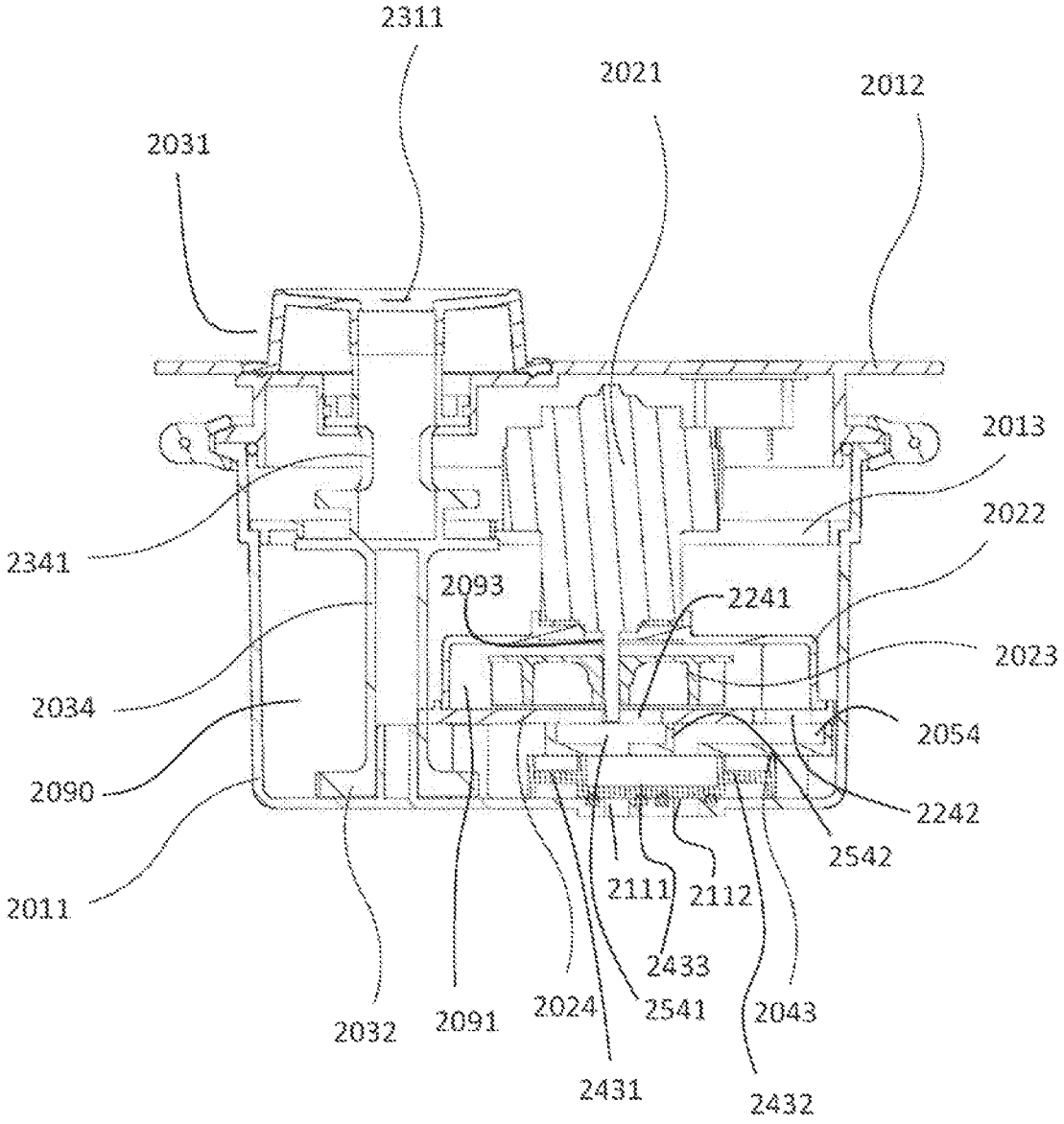
FIG. 11 illustrates a cross section view of the air assembly of FIG. 10, taken along the C-C line, illustrating the interior of the exemplary air assembly.
Figure 12:
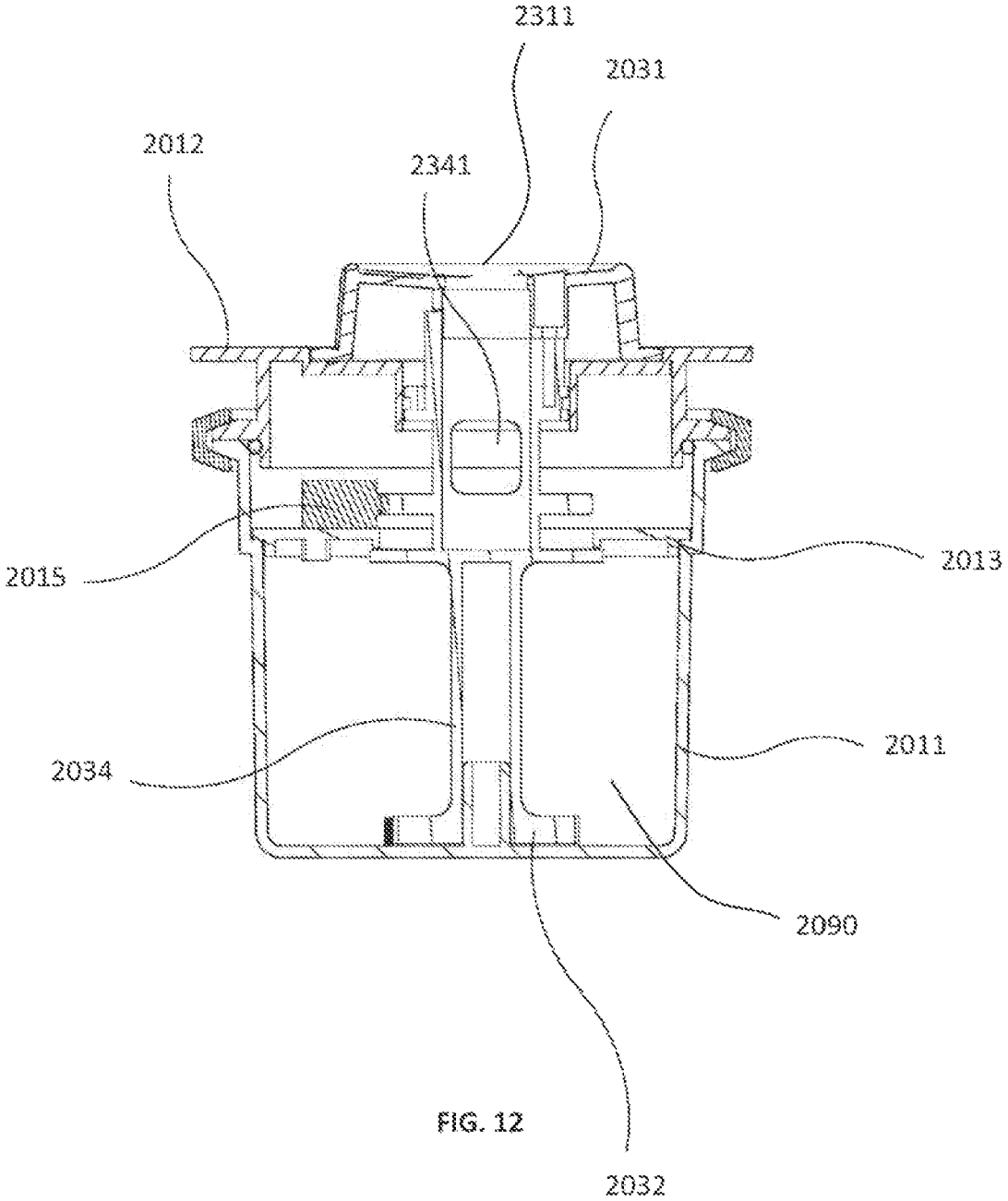
FIG. 12 illustrates a cross section view of the air assembly of FIG. 10, taken along the D-D line, illustrating the interior of the exemplary air assembly from another view.

As illustrated in FIGS. 9 and 11, the translating core 2043 includes an inlet vent 2431 to selectively communicate with the air inlet 2111 of the main body 2011 and air inlet 2241 of the pump cover 2024; an outlet vent 2432 to selectively communicate with the air outlet 2112 of the main body 2011 and the air outlet 2242 of the pump cover, and a baffle 2433 disposed between the inlet vent 2431 and the outlet vent 2432 to selectively close the air inlet 2111 and/or the air outlet 2112 of the main body 2011 as the translating core 2043 translates, with the gaskets 2092 (FIG. 8) creating an air-tight seal between the translating core 2043, the air inlet 2111, and the air outlet 2112.

Figure 14:
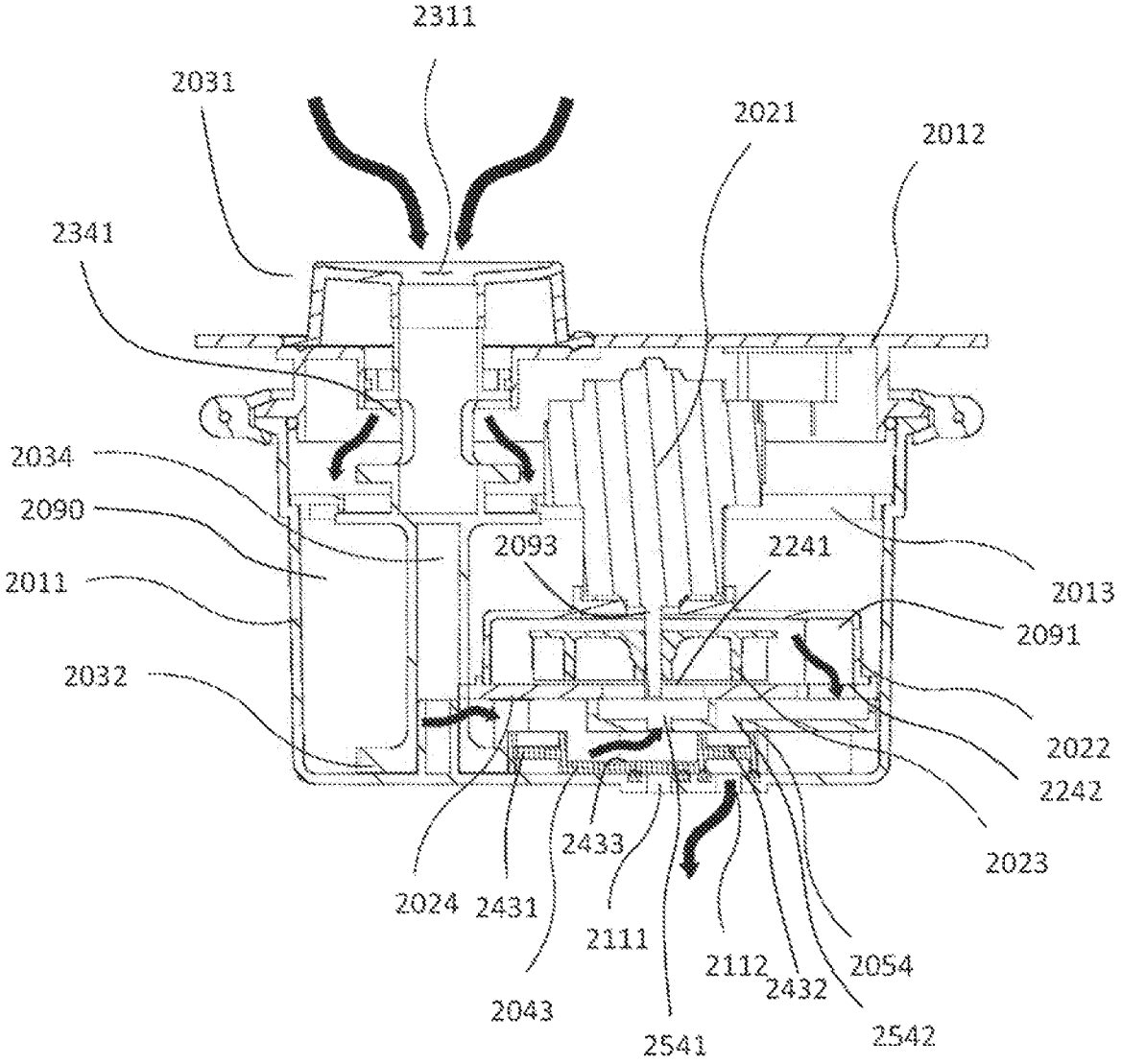
FIG. 14 illustrates a cross section view of the air assembly of FIG. 8 in an inflation state, illustrating the path of air flow through the air assembly during inflation of an inflatable product.
Figure 15:
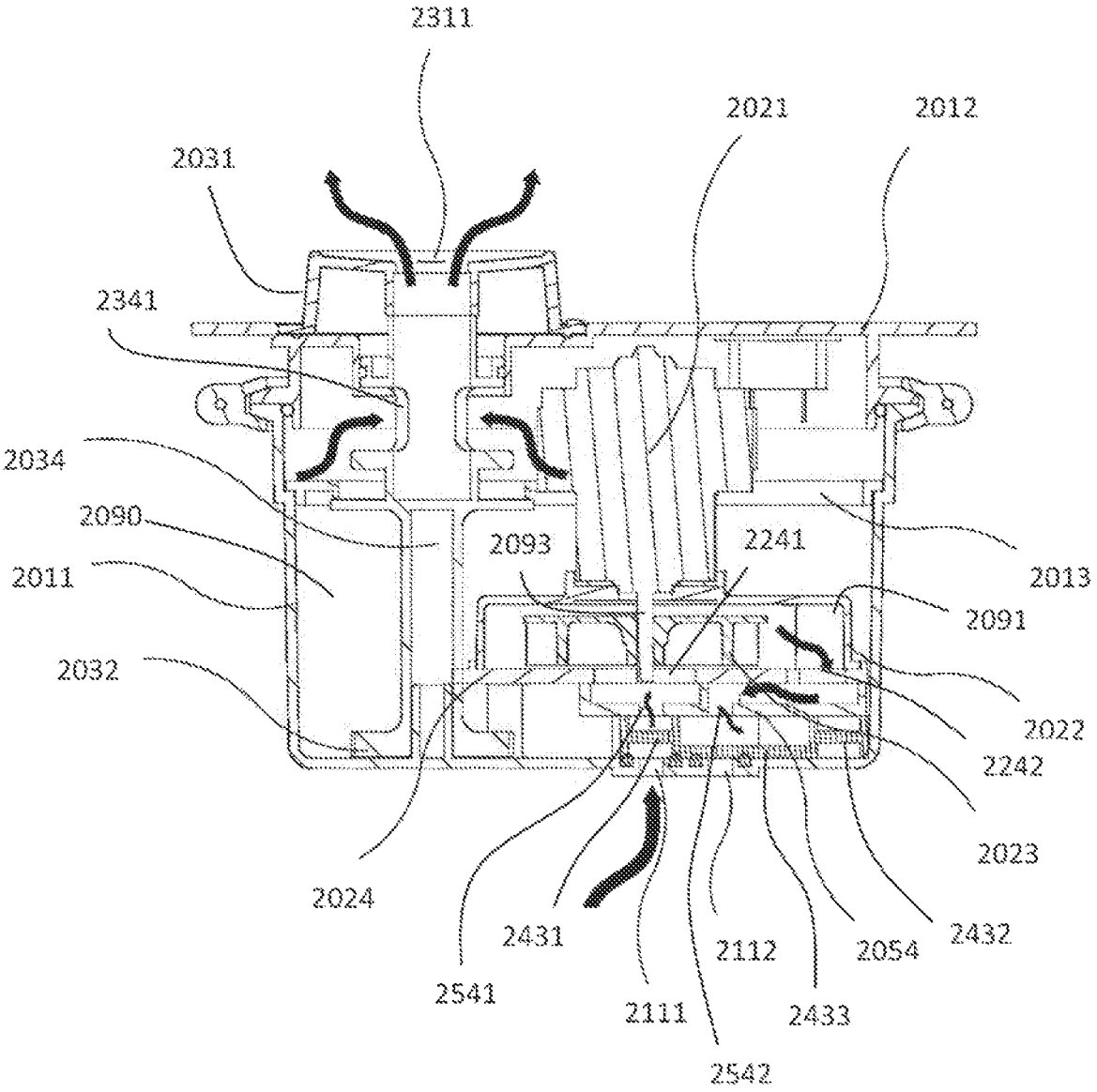
FIG. 15 illustrates a cross section view of the air assembly of FIG. 8 in a deflation state, illustrating the path of air flow through the air assembly during deflation of an inflatable product.
Figure 16:
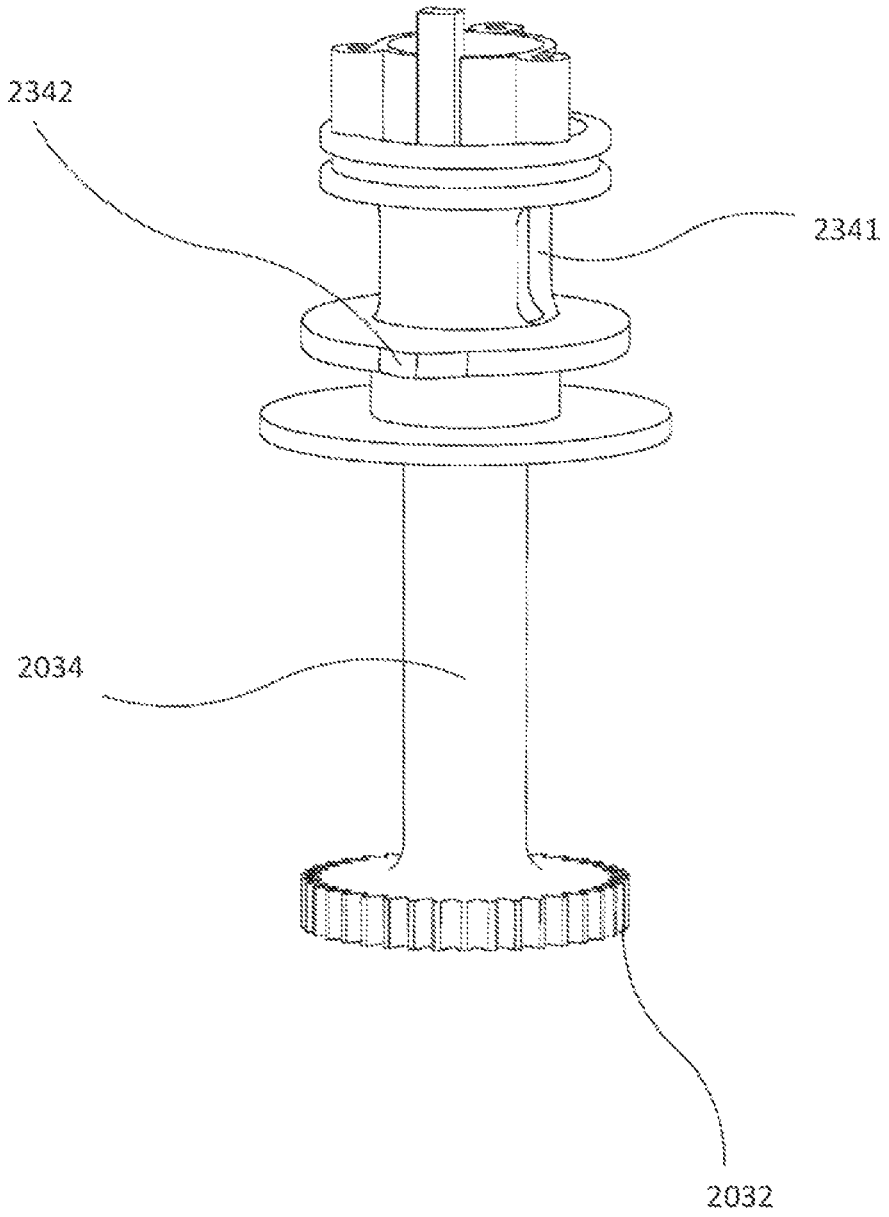
FIG. 16 illustrates a perspective view of a transmission member of the air assembly of FIG. 8.

Referring to FIGS. 8 and 11, in some embodiments, an intermediate guide plate 2054 may be disposed between the pump cover 2024 and the translating core 2043. The guide plate 2054 includes two guide arms 2543*a* and 2543*b* opposite to each other so that the translating core 2043 is received between the guide arms 2543*a-b*, and the guide arms 2543*a-b* guide the translating core 2043 as translating core 2043 translates relative to the guide plate 2054 during operation of the air assembly 2000. The guide plate 2054 further includes an inlet vent 2541 in communication with the air inlet 2241 of the pump cover 2024 and in selective communication with the inlet vent 2431 of the translating core 2043. The guide plate 2054 also includes an outlet vent 2542 in communication with the air outlet 2242 of the pump cover 2042 and in selective communication with outlet vent 2432 of the translating core 2043. For example, in an inflation state, as shown in FIG. 14, the outlet vent 2432 of the translating core 2043 is in selective communication with the air outlet 2242 of the pump cover 2024 via the outlet vent 2542 of the guide plate 2054. In a deflation state, as shown in FIG. 15, the inlet vent 2431 of the translating core 2043 is in selective communication with the air inlet 2241 of the pump cover 2024 via the inlet vent 2541 of the guide plate 2054. In other embodiments, air assembly 2000 may not include the guide plate 2054, so that the inlet vent 2431 of the translating core 2043 may come into direct selective communication with the air inlet 2241 of the pump cover 2024 and the outlet vent 2432 of the translating core 2043 may come into direct selective communication with the air outlet 2242 of the pump cover 2024.

Figure 10:
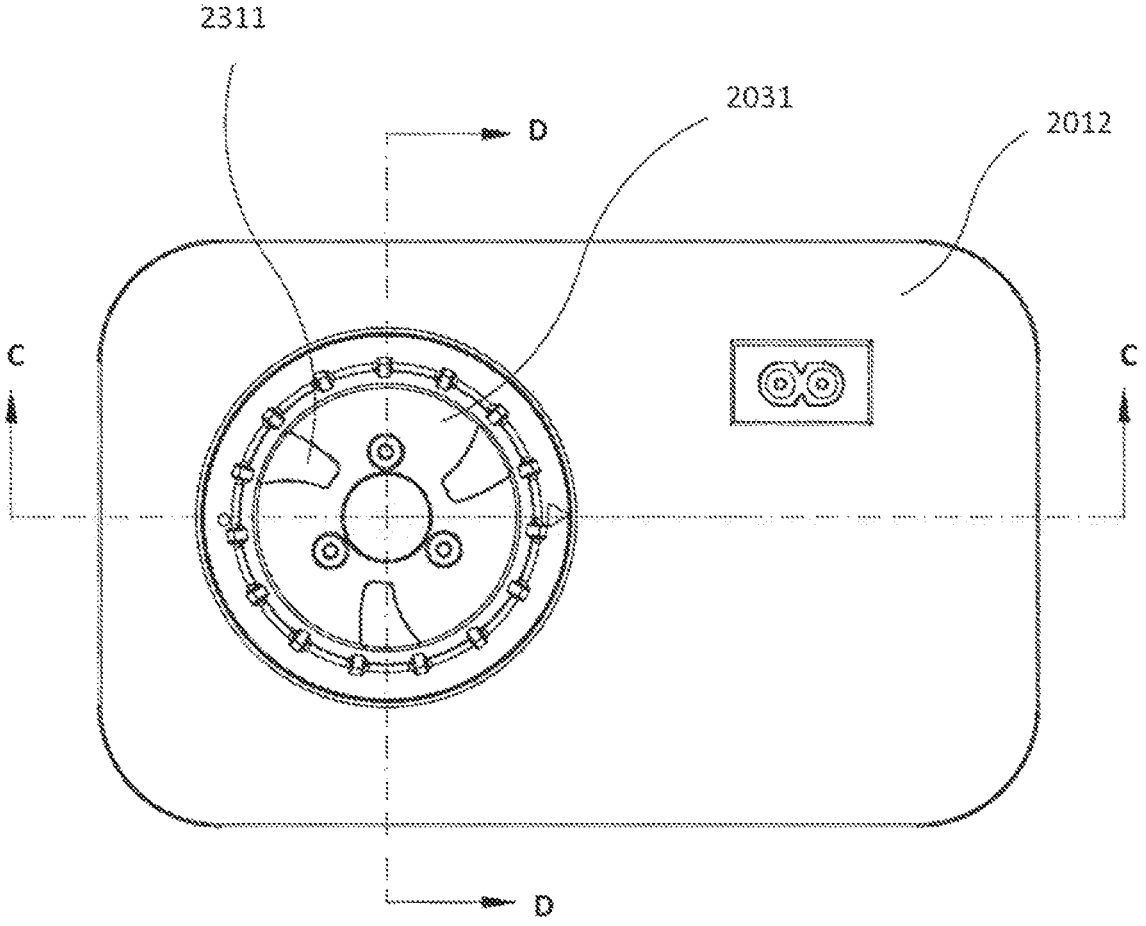
FIG. 10 illustrates a top, plan view of the air assembly of FIG. 8, illustrating the control panel of the exemplary air assembly.

Referring now to FIG. 10, similar to air assembly 1000, the hand wheel 2031 of air assembly 2000 may be rotated by a user to adjust between the inflation, closed, and deflation states.

Figure 13:
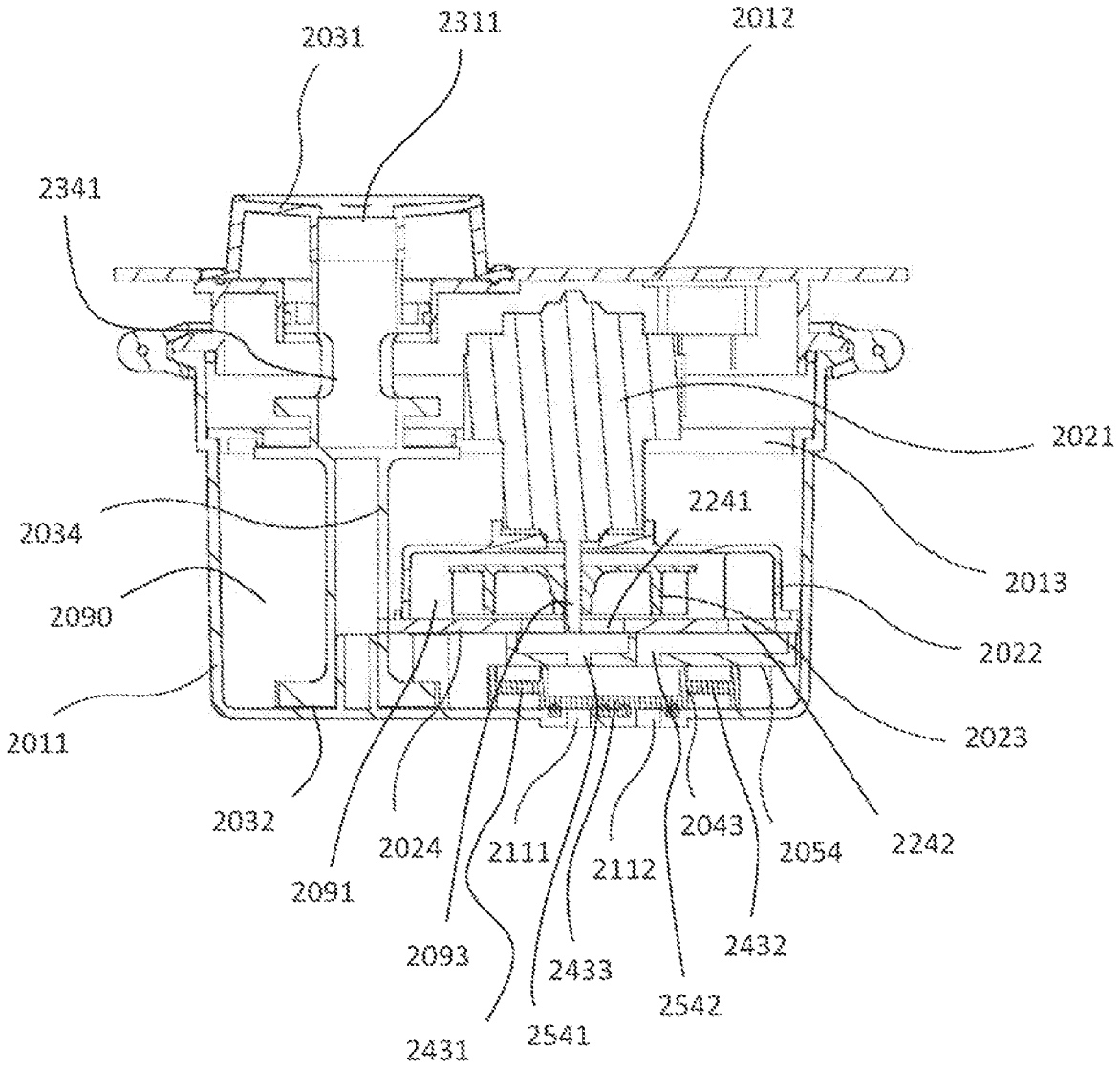
FIG. 13 illustrates a cross section view of the air assembly of FIG. 8, illustrating the interior of the exemplary air assembly when the air assembly is in a closed state.

When the air assembly 2000 is not in use, the hand wheel 2031 remains in the closed state as shown in FIG. 13, and the baffle 2433 of the translating core 2043 closes both the air inlet 2111 and the air outlet 2112 of the main body 2011. The motor 2021 may also stop operating as described above.

As illustrated in FIG. 14, when the user rotates the hand wheel 2031 in a first direction to the inflation state, the motor 2021 starts via the protrusion 2342*a* on the rotating control shaft 2034 and the microswitch 2015 as described above, and the motor 2021 drives the impeller 2023 to rotate via rotating motor shaft 2093. The gear 2032 rotates along with the rotating control shaft 2034 and the hand wheel 2031 to engage with the tooth edge 2441 of the connecting arm 2434 of the translating core 2043 to cause the translating core 2043 to translate to the left in FIG. 14. In this position, the outlet vent 2432 of the translating core 2043 aligns with the air outlet 2242 of the pump cover 2024 and the air outlet 2112 of the main body 2011 while the baffle 2433 of the translating core 2043 closes the air inlet 2111 of the main body 2011. The inflatable product P is inflated as air is drawn in through the wheel vent 2311 by impeller 2023 and moves through the created airway.

When the inflatable product P (FIG. 4A) has been inflated to a desired pressure, the user may return hand wheel 2031 to the closed state (FIG. 13) so that the baffle 2433 of the translating core 2043 closes both the air inlet 2111 and the air outlet 2112 of the main body 2011 and the motor 2021 stops operating as described above.

As illustrated in FIG. 15, when the user rotates the hand wheel 2031 in a second direction to the deflation state, the motor 2021 starts via the protrusion 2342*b* on the rotating control shaft 2034 and the microswitch 2015 as described above, and the motor 2021 drives the impeller 2023 to rotate via rotating motor shaft 2093. The gear 2032 rotates along with the rotating control shaft 2034 and the hand wheel 2031 to engage with the rack 2441 of the connecting arm 2434 of the translating core 2043 to cause the translating core 2043 to translate. When the translating core 2043 translates, the inlet vent 2431 of the translating core 2043 aligns with the air inlet 2241 of the pump cover 2024 and the air inlet 2111 of the main body 2011, while the baffle 2433 of the translating core 2043 closes the air outlet 2112 of the main body 2011. Thus, the deflation state is implemented as air is drawn in through the air inlet 2111 of the main body 2011 and moves through the created airway. When the inflatable product P (FIG. 4A) has been deflated entirely or to a desired pressure, the user may return hand wheel 2031 to the closed state (FIG. 13) so that the baffle 2433 of the translating core 2043 closes both the air inlet 2111 and the air outlet 2112 of the main body 2011 and the motor stops operating as described above.

Now referring generally to FIGS. 17-23, another embodiment of air assembly 3000 is disclosed. The air assembly 3000 has substantially the same structure and operation as the air assembly 1000, except as described below. Like elements of the air assembly 3000 are identified by adding "2000" to the corresponding reference number of the air assembly 1000.

Figure 17:
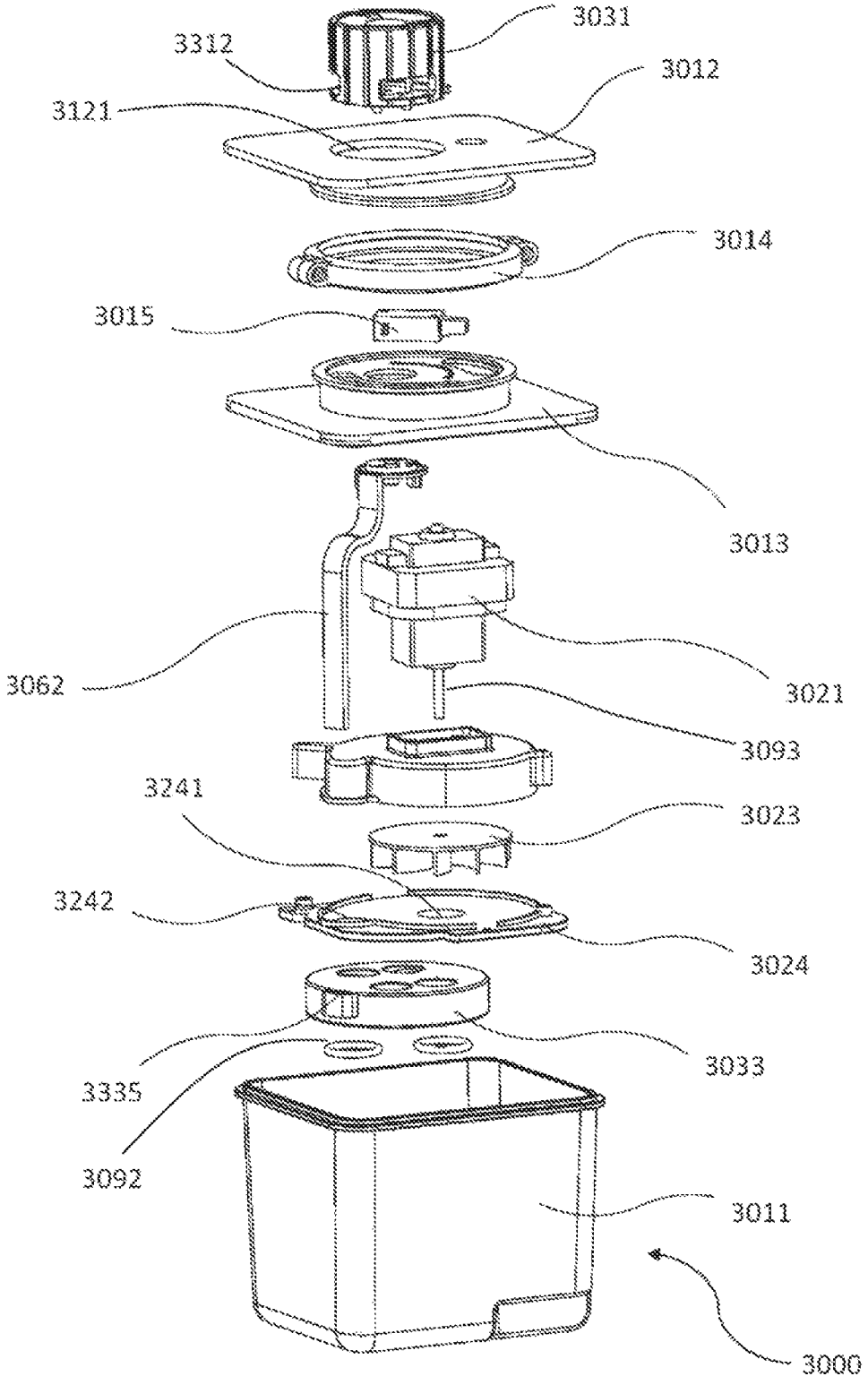
FIG. 17 illustrates an exploded, perspective view of a third exemplary air assembly, including a main body, a control panel, and a rotating directional control valve.
Figure 18:
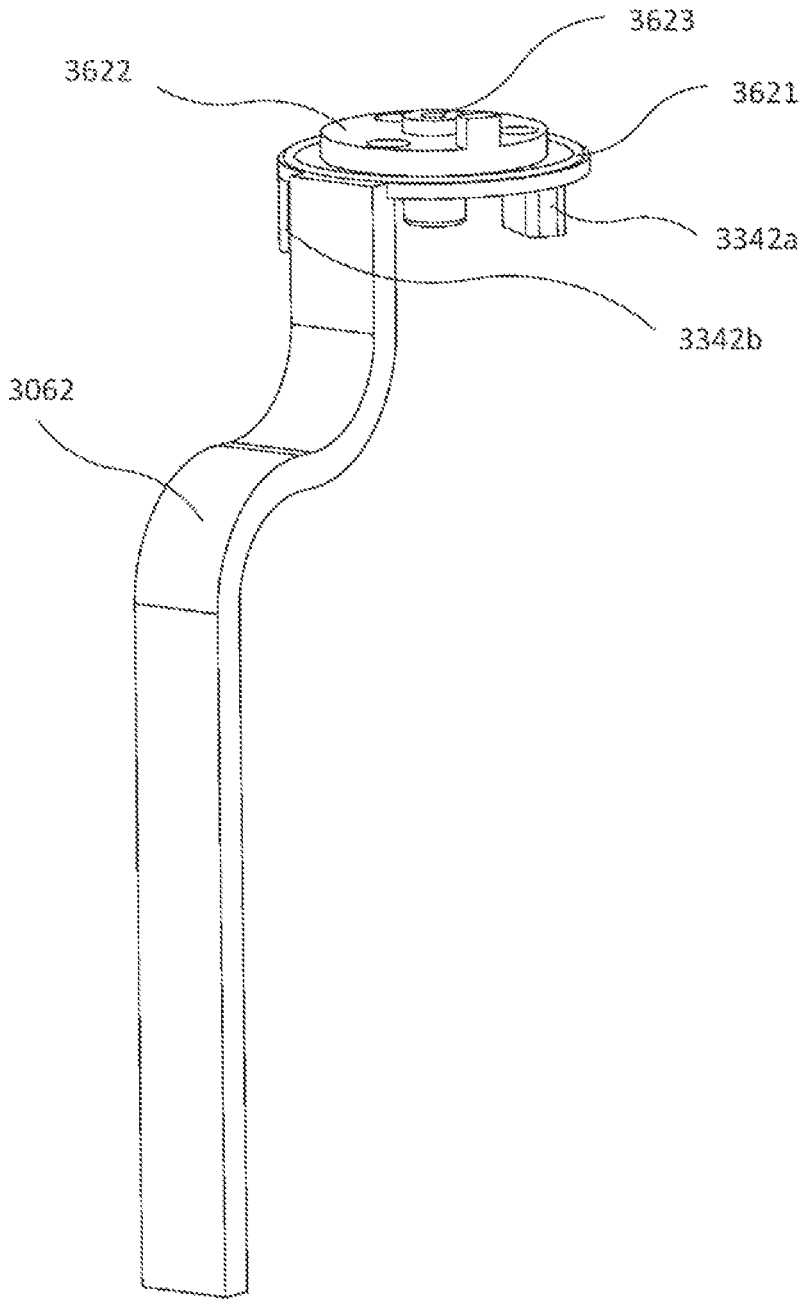
FIG. 18 illustrates a perspective view of a transmission member of the air assembly of FIG. 17.

As illustrated in FIGS. 17-18, the hand wheel 3031 supported by the control panel 3012 over the control panel vent 3121 is coupled to a transmission member in the form of a swing bar 3062, which includes a connector 3621, illustrated as a disc-shaped extension that extends horizontally outward from a vertical axis of the swing bar 3062. A portion of an upper face of the connector 3621 protrudes upward to form a fixing step 3622 which passes through the panel 3013 to couple to the hand wheel 3031, such as with a connection shaft 3623, so that a rotating directional control valve or disc 3033 rotates along with the hand wheel 3031. The hand wheel 3031 may include a centrally disposed main wheel vent 3311 in communication with the surrounding environment and at least one radially disposed side wheel vent 3312 disposed on a sidewall of the hand wheel 3031 and in communication with the main body chamber 3090. The swing bar 3062 is further provided with two sensed protrusions 3342*a-b* coupled to a lower end face of the connector 3621, which are configured to selectively touch the microswitch 3015 supported by the panel 3013 when a user rotates the hand wheel 3031. At its lower end opposite the connector 3621, the swing bar 3062 is coupled to a fixing hole 3335 of the rotating disc 3033 so that rotating disc 3033 is rotated via the swing bar 3062 when the user rotates the hand wheel 3031. Gaskets 3092 are fitted between the rotating disc 3033, the air inlet 3111, and the air outlet 3112 to prevent the leakage of air before and after inflation or deflation of the inflatable product P (FIG. 4A).

Figure 19:
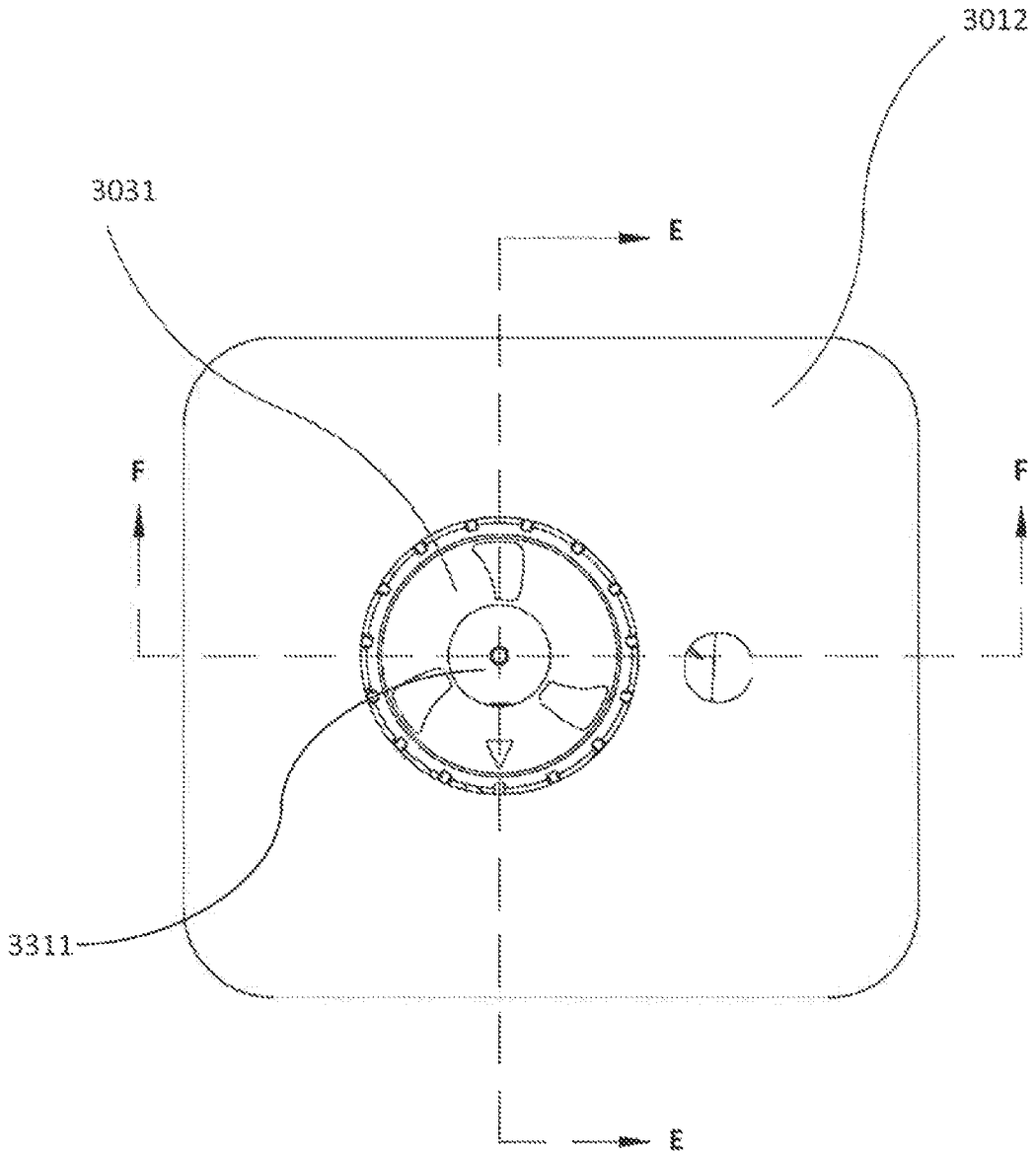
FIG. 19 illustrates a top, plan view of the air assembly of FIG. 17, illustrating the control panel of the exemplary air assembly.
Figure 20:
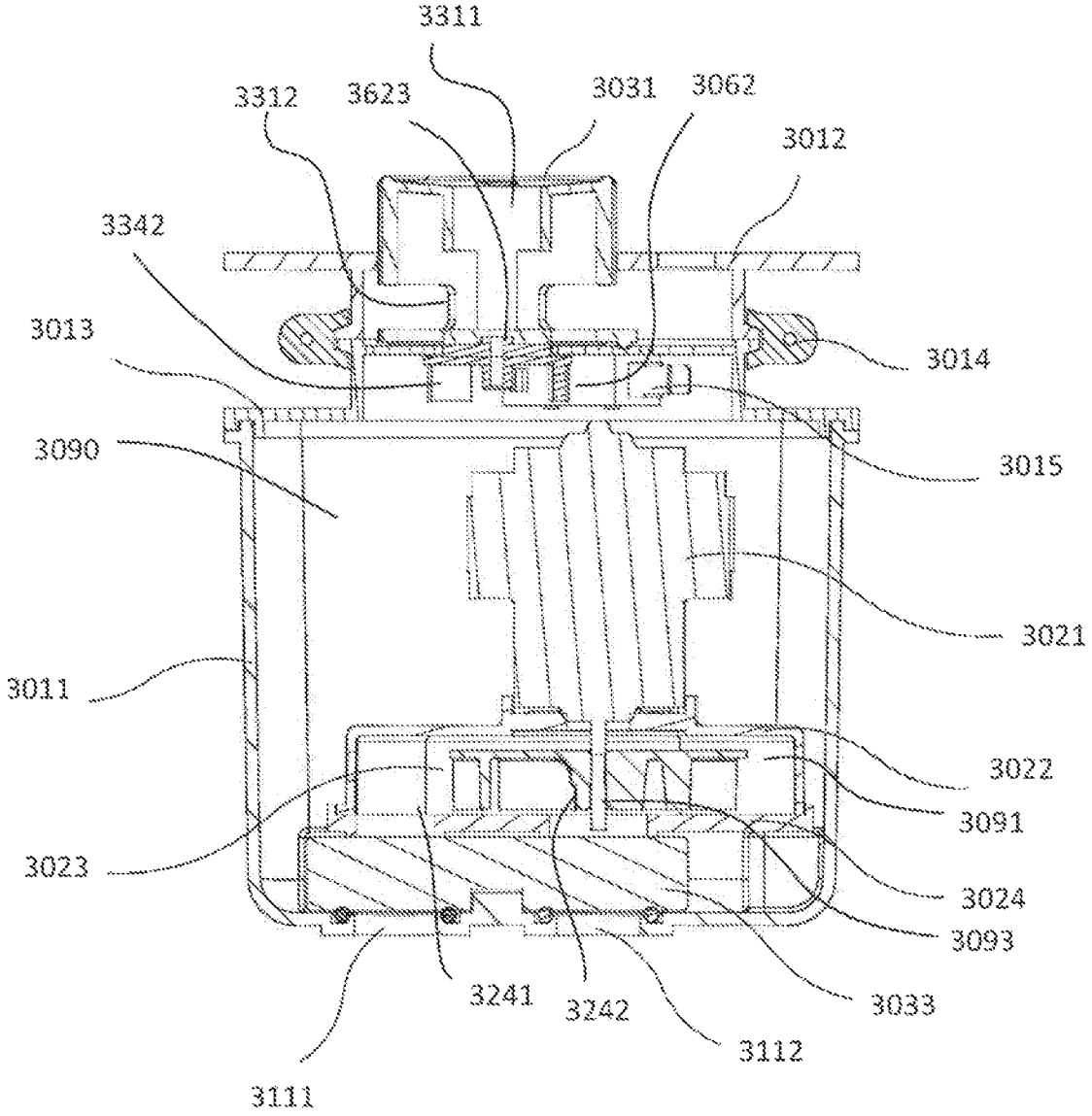
FIG. 20 illustrates a cross section view of the air assembly of FIG. 19, taken along the F-F line, illustrating the interior of the exemplary air assembly when the air assembly is in a closed state.
Figure 21:
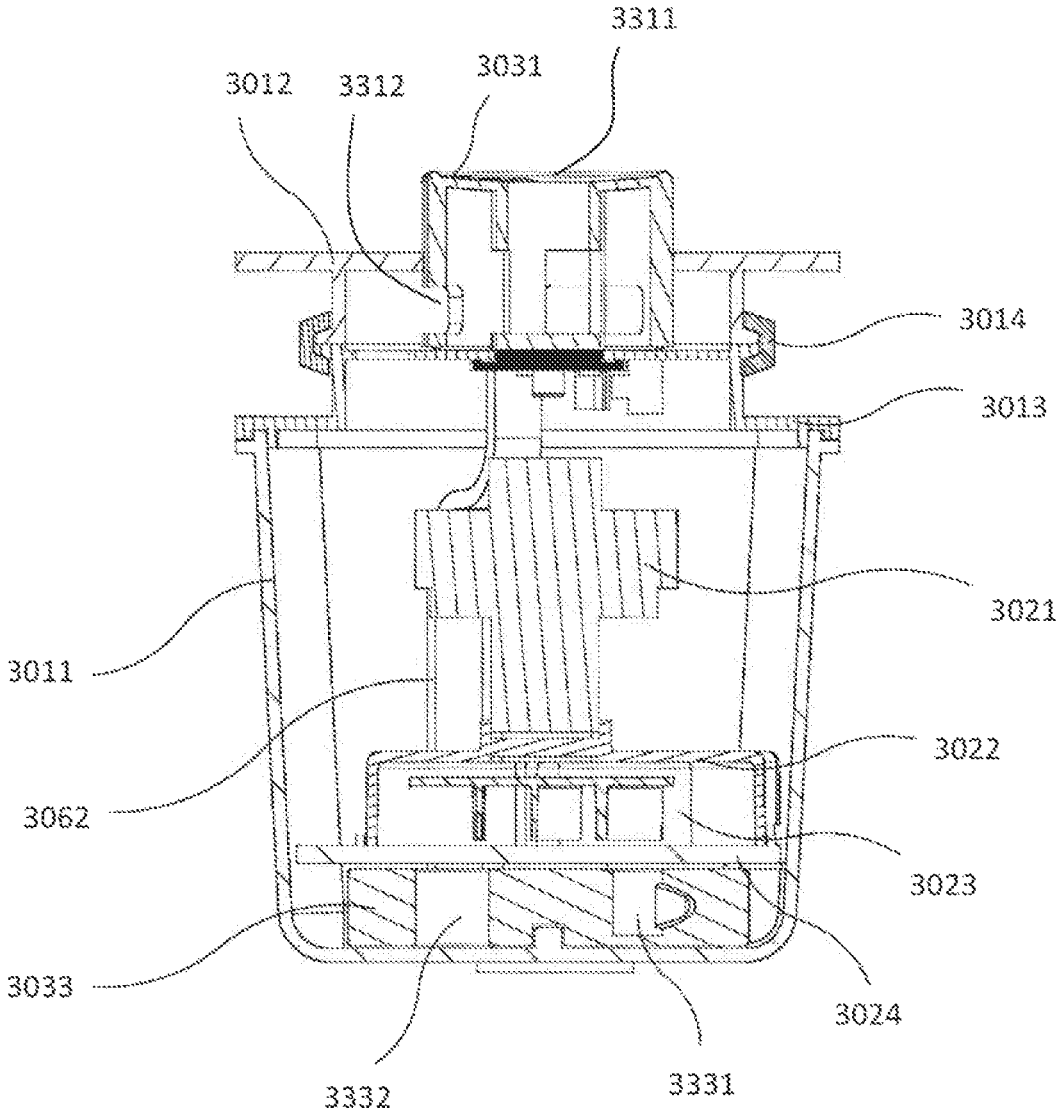
FIG. 21 illustrates a cross section view of the air assembly of FIG. 19, taken along the E-E line, illustrating the interior of the exemplary air assembly from another view.

As shown in FIG. 19, and similar to air assembly 1000, the hand wheel 3031 of air assembly 3000 may be rotated by a user to adjust the air assembly 3000 between the inflation, closed, and deflation states. When the air assembly 3000 is not in use, the hand wheel 2031 remains in the closed state, with the gaskets 3092 (FIG. 17) creating an air-tight seal between the rotating disc 3033, the air inlet 3111, and the air outlet 3112.

Figure 22:
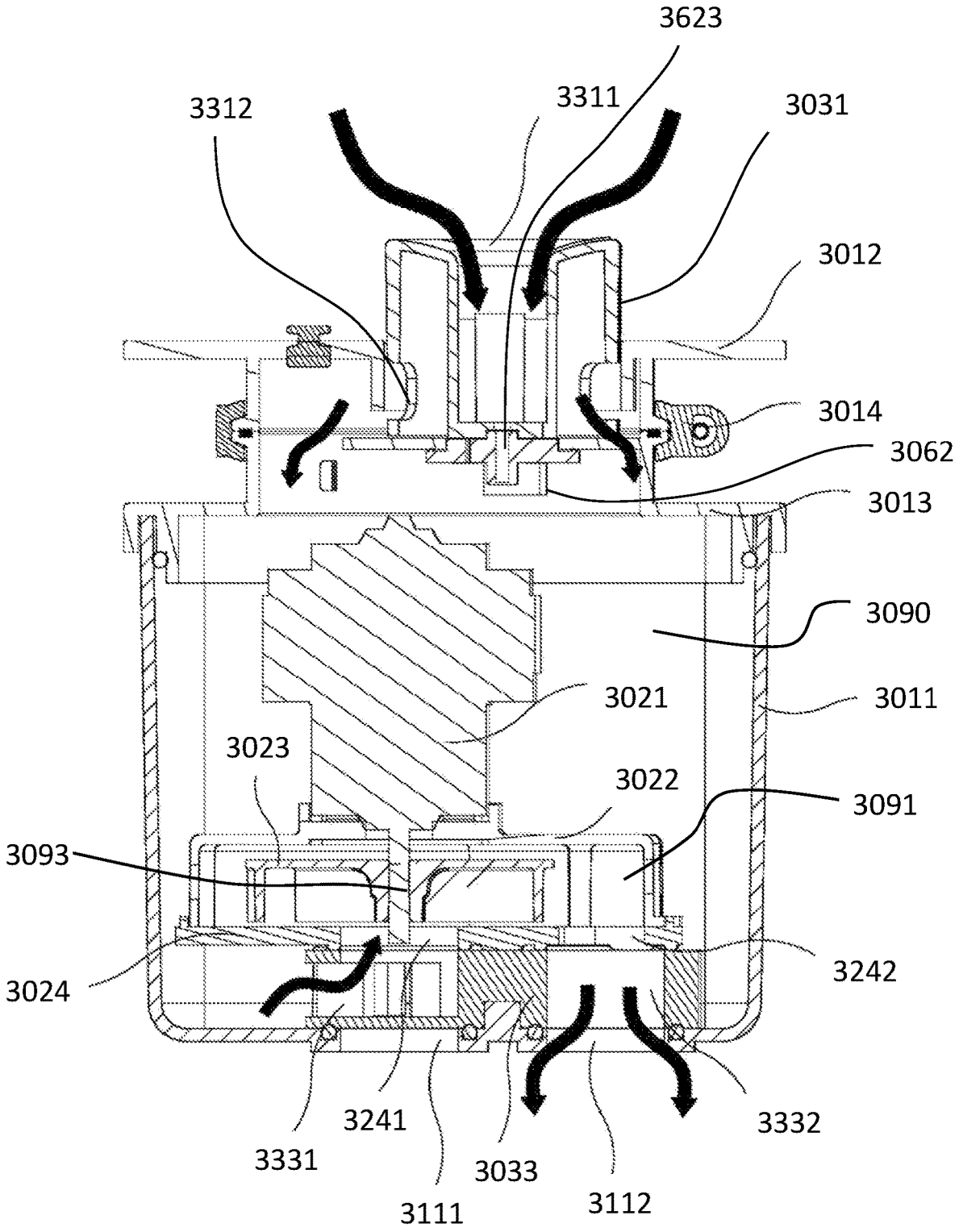
FIG. 22 illustrates a cross section view of the air assembly of FIG. 17 in an inflation state, illustrating the path of air flow through the air assembly during inflation of an inflatable product.

When the user rotates the hand wheel 3031 in a first direction to the inflation state as illustrated in FIG. 22, the rotating disc 3033 is rotated via the swing bar 3062 so that the air outlet 3112 of the main body 3011 is opened and air inlet 3111 of the main body 3011 is closed, and the protrusion 3342*a* of the swing bar 3062 touches the microswitch 3015 (FIGS. 17 and 18) to start the motor 3021. Then, the motor 3021 drives the impeller 3023 to rotate, drawing ambient air into the main body chamber 3090 via the main wheel vent 3311 and side wheel vent 3312 of the hand wheel 3031. Next, the air is drawn into the impeller chamber 3091 through the first L-shaped inlet vent 3331 of the rotating disc 3033 and the air inlet 3241 of the pump cover 3024. The air then moves through the air outlet 3242 of the pump cover 3024 and the first outlet vent 3332 of the rotating disc 3033, where the air is free to enter and inflate the inflatable product P (FIG. 4A) through the air outlet 3112 of the main body 3011. When the inflatable product P (FIG. 4A) has been inflated to a desired pressure, the user may return hand wheel 3031 to the closed state (FIG. 20) so that the air inlet 3111 and the air outlet 3112 of the main body 3011 are closed and the motor 3021 stops operating as described above.

Figure 23:
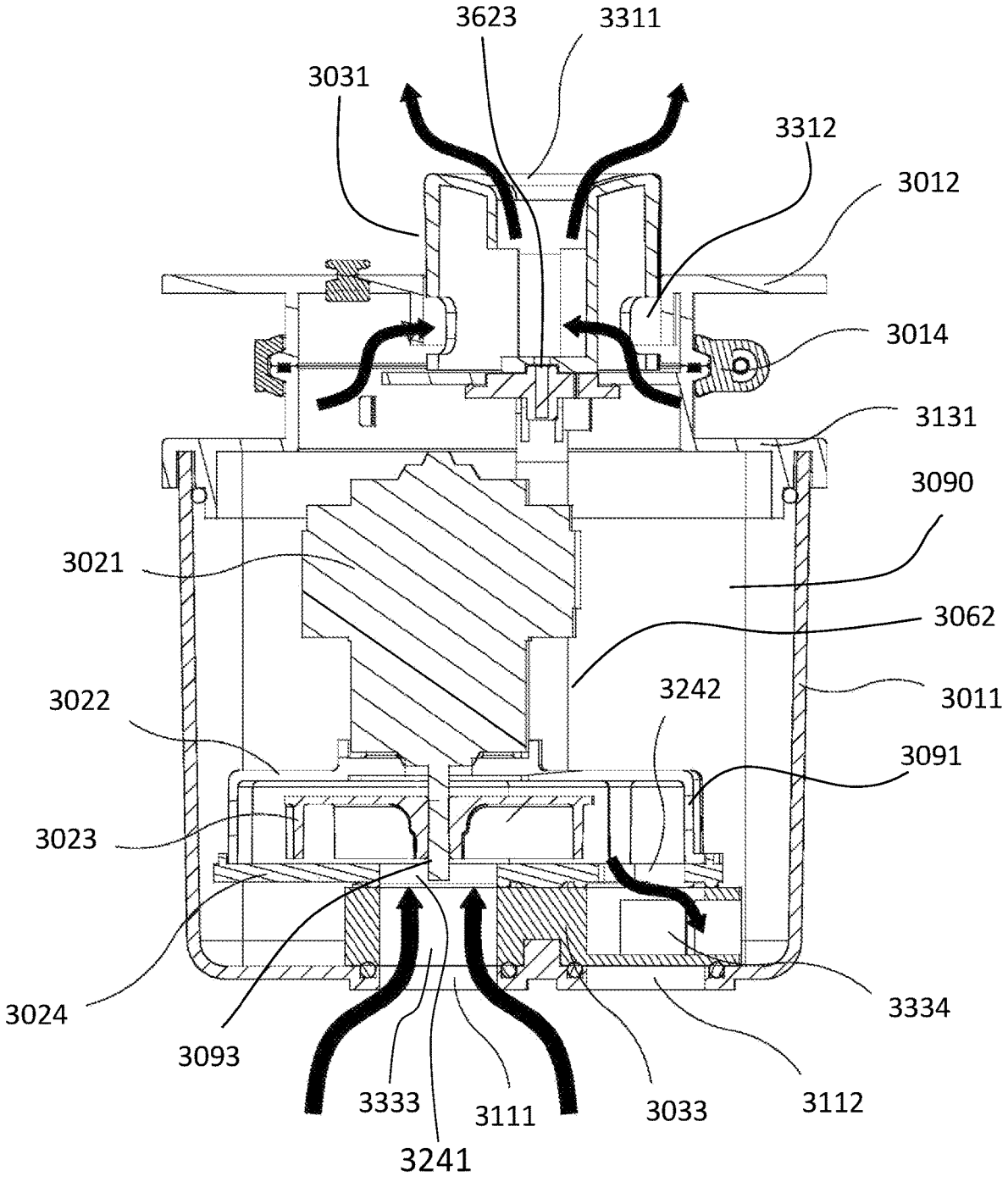
FIG. 23 illustrates a cross section view of the air assembly of FIG. 17 in a deflation state, illustrating the path of air flow through the air assembly during deflation of an inflatable product.

Now referring to FIG. 23, when the user rotates the hand wheel 3031 in a second direction to the deflation state, the rotating disc 3033 is rotated via the swing bar 3062 so that the air inlet 3111 of the main body 3011 is opened and air outlet 3112 of the main body 3011 is closed, and the protrusion 3342*b* of the swing bar 3062 touches the microswitch 3015 (FIGS. 17 and 18) to start the motor 3021. Then, the motor 3021 drives the impeller 3023 to rotate, drawing the air from the inflatable product P into the impeller chamber 3091 through the air inlet 3111 of the main body 3011, the second inlet vent 3333 of the rotating disc 3033, and the air inlet 3241 of the pump cover 3024. The air then moves through air outlet 3242 of the pump cover 3024 and the second L-shaped outlet vent 3334 of the rotating disc 3033 to enter the main body chamber 3090. The air is then free to exit the air assembly 3000 via the side wheel vent 3312 and the main wheel vent 3311 of the hand wheel 3031, thus deflating the inflatable product P. When the inflatable product P (FIG. 4A) has been deflated entirely or to a desired pressure, the user may return hand wheel 3031 to the closed state (FIG. 20) so that the air inlet 3111 and the air outlet 3112 of the main body 3011 are closed and the motor 3021 stops operating as described above.

Now referring generally to FIGS. 24-31, another embodiment of the air assembly 4000 is disclosed. The air assembly 4000 has substantially the same structure and operation as the air assembly 1000, except as described below. Like elements of the air assembly 4000 are identified by adding "3000" to the corresponding reference number of the air assembly 1000.

Figure 24:
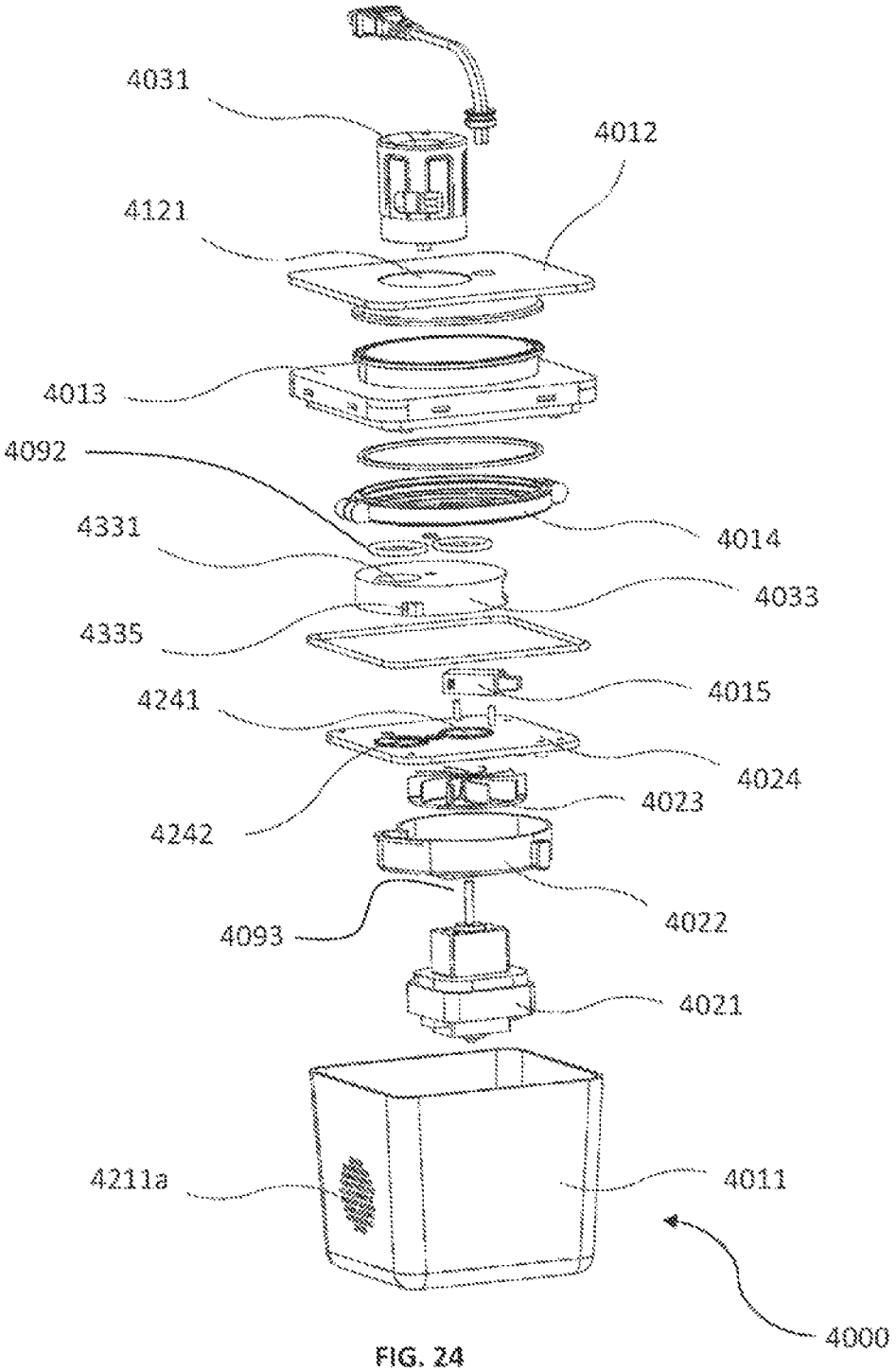
FIG. 24 illustrates an exploded, perspective view of a fourth exemplary air assembly, including a main body, a control panel, and a rotating directional control valve.
Figure 24A:
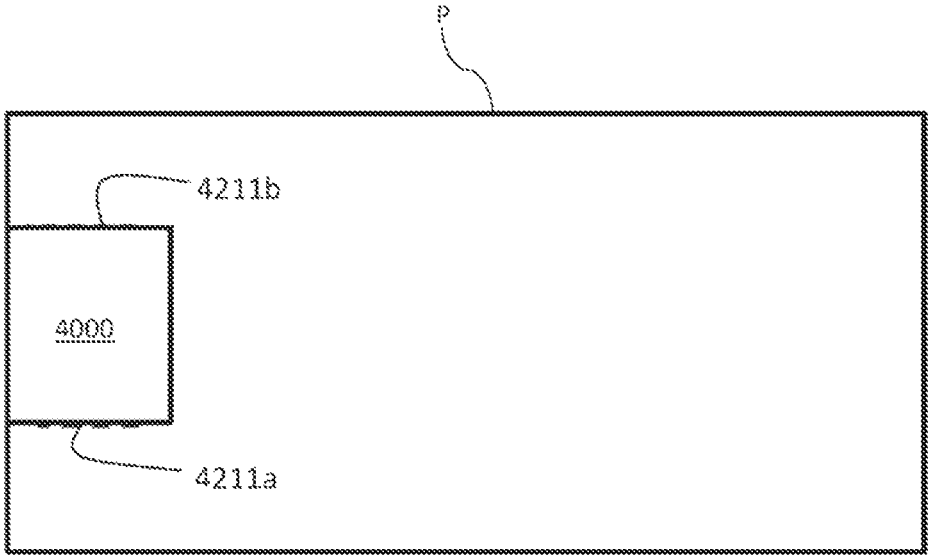
FIG. 24A illustrates a schematic view of the air assembly of FIG. 24 built into an inflatable product.

Like the air assembly 1000, the main body 4011 forms the main body chamber 4090 with an opening. The main body 4011 further has at least one inflation/deflation port 4211, which is in communication with an inflatable product P (FIG. 24A). As illustrated, the main body 4011 may have two inflation/deflation ports 4211*a-b* located on opposing sidewalls of the main body 4011. In other embodiments, more or fewer inflation ports 4211 may be located at other positions on the main body 4011.

Figure 25:
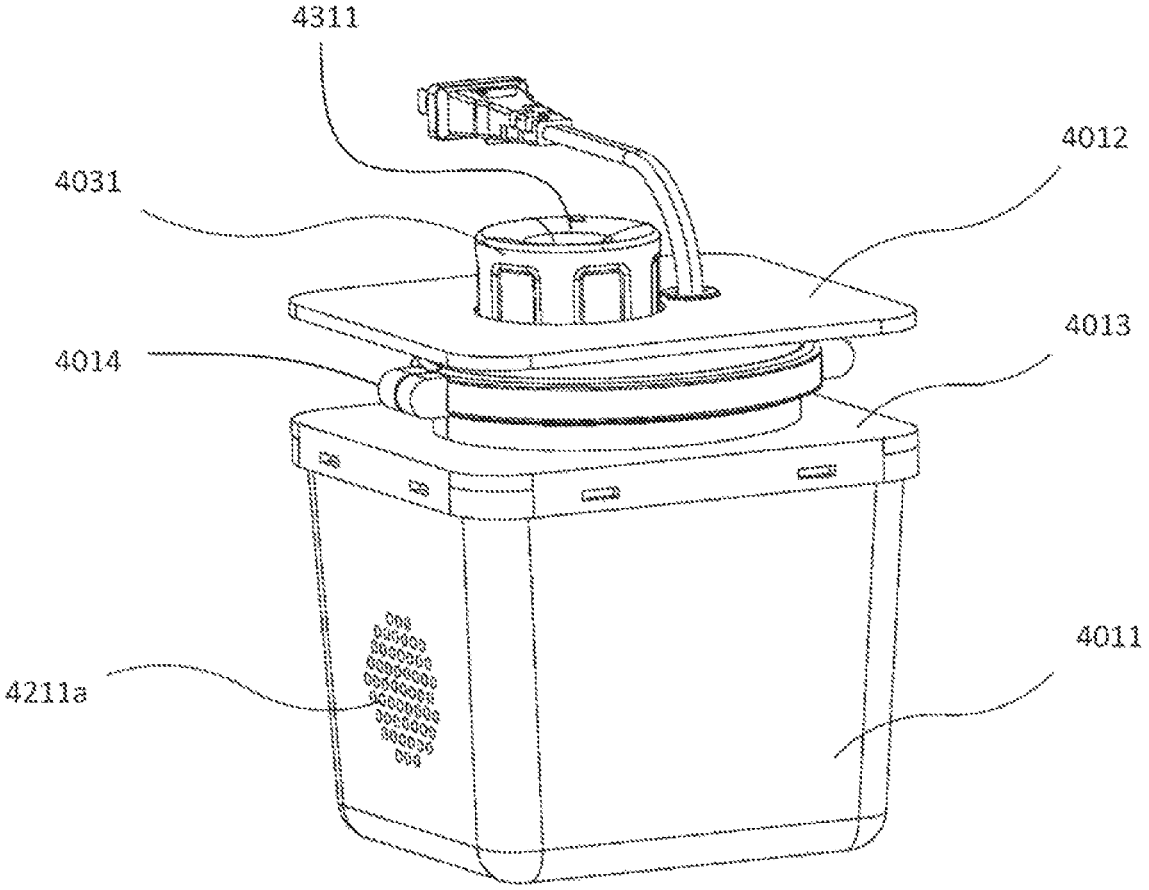
FIG. 25 illustrates a perspective view of the air assembly of FIG. 24, illustrating the exterior structure of the exemplary air assembly.

Referring now to FIG. 25, the control panel 4012 is spaced apart from the main body 4011 and the panel 4013 via the removable fixing ring 4014. The panel 4013 encloses the main body chamber 4090. Additionally, as illustrated in FIGS. 27-31, the panel 4013 divides the main body chamber 4090 formed by the main body 4011 into a first, upper chamber 4094 and a second, lower chamber 4095. The first chamber 4094 is in communication with the vent 4121 of the control panel 4012 (FIG. 24) and the hand wheel 4031, while the second chamber 4095 is in communication with the inflation/deflation ports 4211*a-b* of the main body 4011. The panel 4013 is provided with an inflation vent 4131 and a deflation vent 4132 for selective communication with the first chamber 4094. Gaskets 4092 (FIG. 24) are fitted between the rotating disc 3033, the inflation vent 4131 of panel 4013, and the deflation vent 4132 of the panel 4013 to prevent the leakage of air before and after inflation or deflation of the inflatable product P (FIG. 4A).

Referring to FIGS. 25-29, as with previous embodiments, the hand wheel 4031 sits over the vent 4121 of the control panel 4012. The hand wheel 4031 is provided with a wheel vent 4311 in communication with the first chamber 4094. In an illustrative embodiment, the hand wheel 4031 is fixedly coupled to a rotating directional control valve or disc 4033 through a connection shaft 4313 so that the rotating disc 4033 is disposed in the second chamber 4095 and rotates along with the hand wheel 4031. In other embodiments, the hand wheel 4031 may be coupled to the rotating disc 4033 through other means.

Referring now to FIGS. 24 and 27-31, the rotating disc 4033 is provided with a first vent 4331 with an opening on each the top face and the bottom face of the rotating disc 4033 and an L-shaped second vent 4332 with an opening on each the bottom face and the sidewall of the rotating disc 3033. One or more sensed protrusions 4335 (FIG. 24) extend from the periphery of the rotating disc 4033 and are configured to be sensed by the microswitch 4015 to operate the motor 4021.

Figure 26:
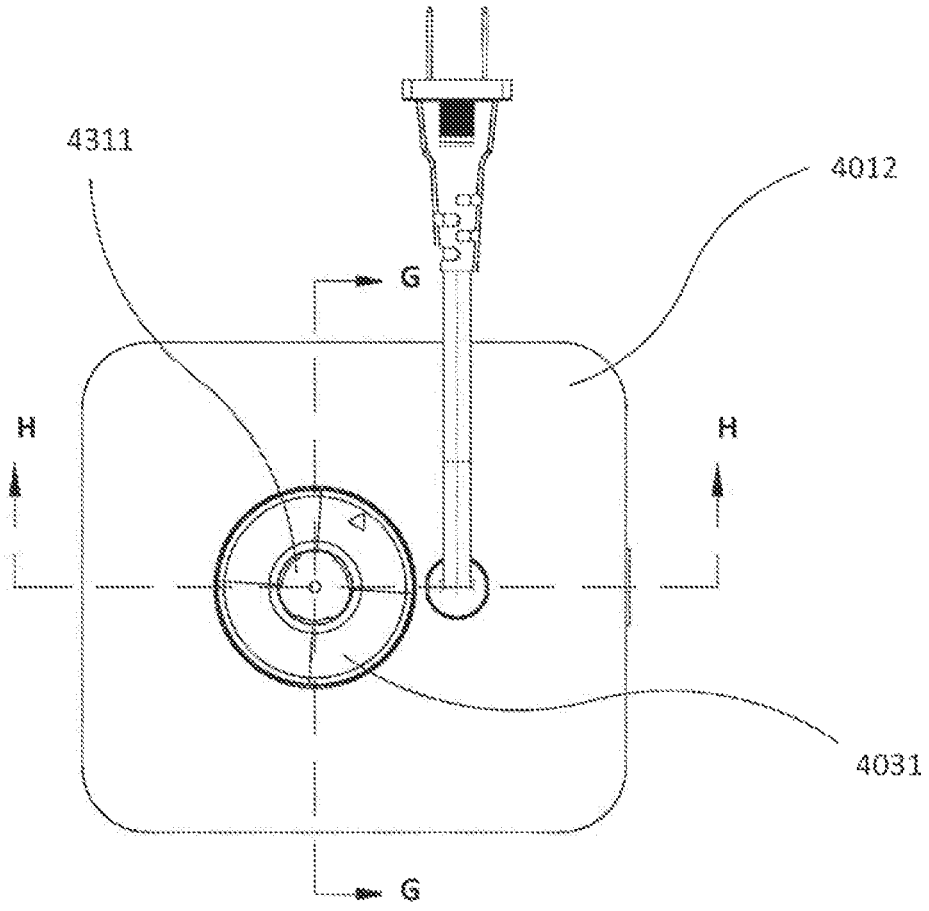
FIG. 26 illustrates a top, plan view of the air assembly of FIG. 24, illustrating the control panel of the exemplary air assembly.

Now referring to FIG. 26, similar to air assembly 1000, the hand wheel 4031 of air assembly 4000 may be rotated by a user to adjust air assembly 4000 between the inflation, closed, and deflation states. When the air assembly 4000 is not in use, the hand wheel 4031 remains in a closed state (FIG. 29) so that both the air inlet 4241 and the air outlet 4242 of the pump cover 4024 are closed by the rotating disc 4033, and the gaskets 4092 (FIG. 24) create an air-tight seal between rotating disc 4033, inflation vent 4131 of panel 4013, and deflation vent 4132 of panel 4013.

Figure 30:
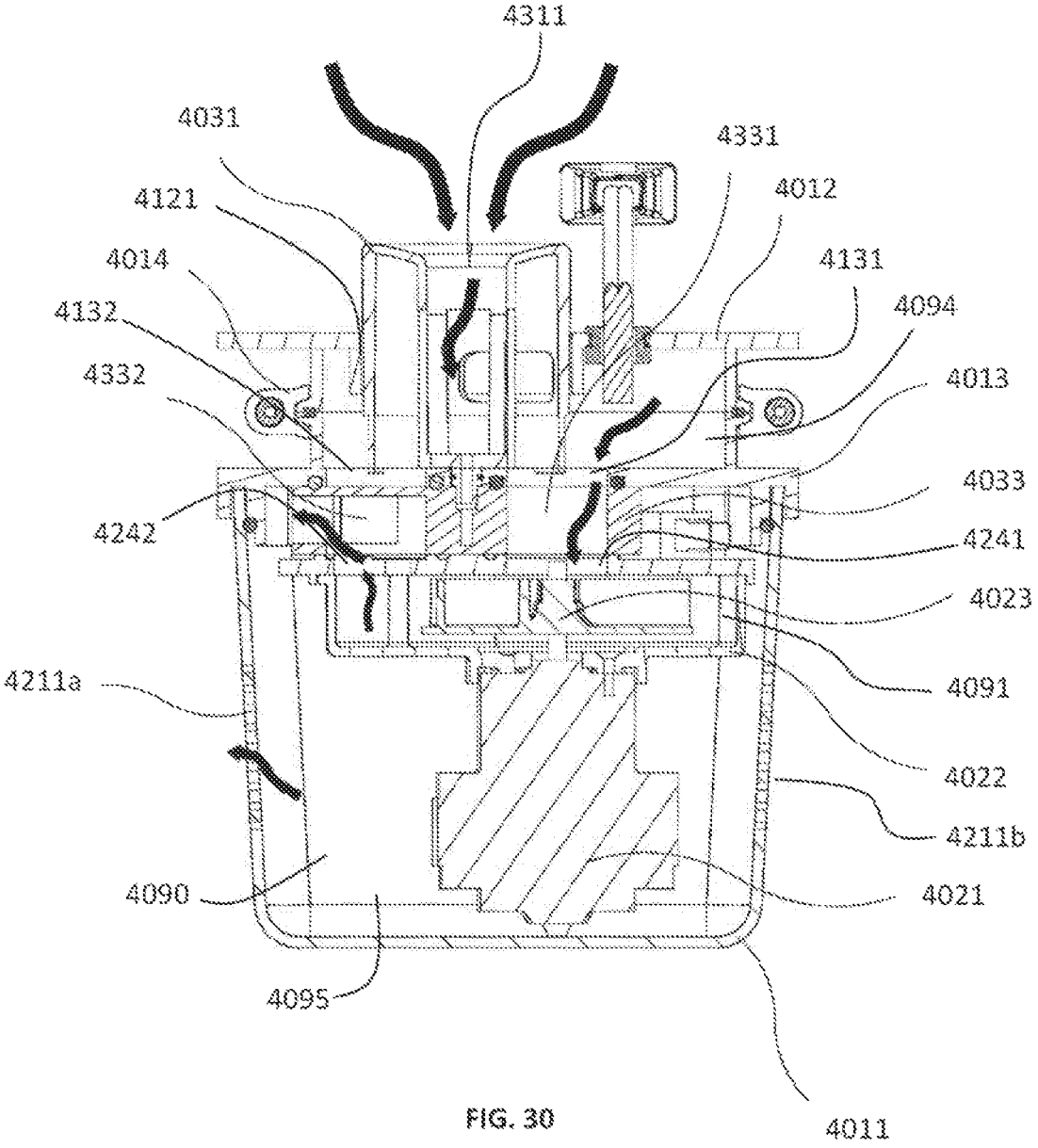
FIG. 30 illustrates a cross section view of the air assembly of FIG. 24 in an inflation state, illustrating the path of air flow through the air assembly during inflation of an inflatable product.

In a first position as illustrated by FIG. 30, the first vent 4331 is in selective communication with the wheel vent 4311 of the hand wheel 4031 via the inflation vent 4131 of the panel 4013 and with the air inlet 4241 of the pump cover 4024, which is also disposed in the second chamber 4095 and supports the microswitch 4015. When the first vent 4331 of the rotating disc 4033 is in this position, the second vent 4332 of the rotating disc 4033 is in selective communication with the air outlet 4242 of the pump cover 4024 and the inflation/deflation ports 4211*a-b* of the main body 4011. This configuration of air assembly 4000 may also be referred to as the inflation state.

When a user rotates the hand wheel 4031 in a first direction to the inflation state as illustrated by FIG. 30, the rotating disc 4033 rotates with the hand wheel 4031 so that one of the sensed protrusions 4335 touches microswitch 4015 (FIG. 24) and starts motor 4021. Additionally, the first vent 4331 comes into the first position described above. The motor 4021 drives the impeller 4023 to rotate, drawing ambient air from outside of the air assembly 4000 into the first chamber 4094 via the wheel vent 4311 of the hand wheel 4031. The air is then drawn into the impeller chamber 4091 through the inflation vent 4131 of the panel 4013, the first vent 4331 of the rotating disc 4033, and the air inlet 4241 of the pump cover 4024. The air then moves through the air outlet 4242 of the pump cover 4024 and the second vent 4332 of the rotating disc 4033 to enter the second chamber 4095 of the main body chamber 4090. The air is then free to move into the inflatable product P (FIG. 24A) via the inflation/deflation ports 4211*a-b*, thus inflating the inflatable product P. When the inflatable product P (FIG. 24A) has been inflated to a desired pressure, the user may return the hand wheel 4031 to the closed state (FIG. 29), thereby closing the air inlet 4241 and the air outlet 4242 of the pump cover 4024, and the motor 4021 stops operating as described above.

Figure 27:
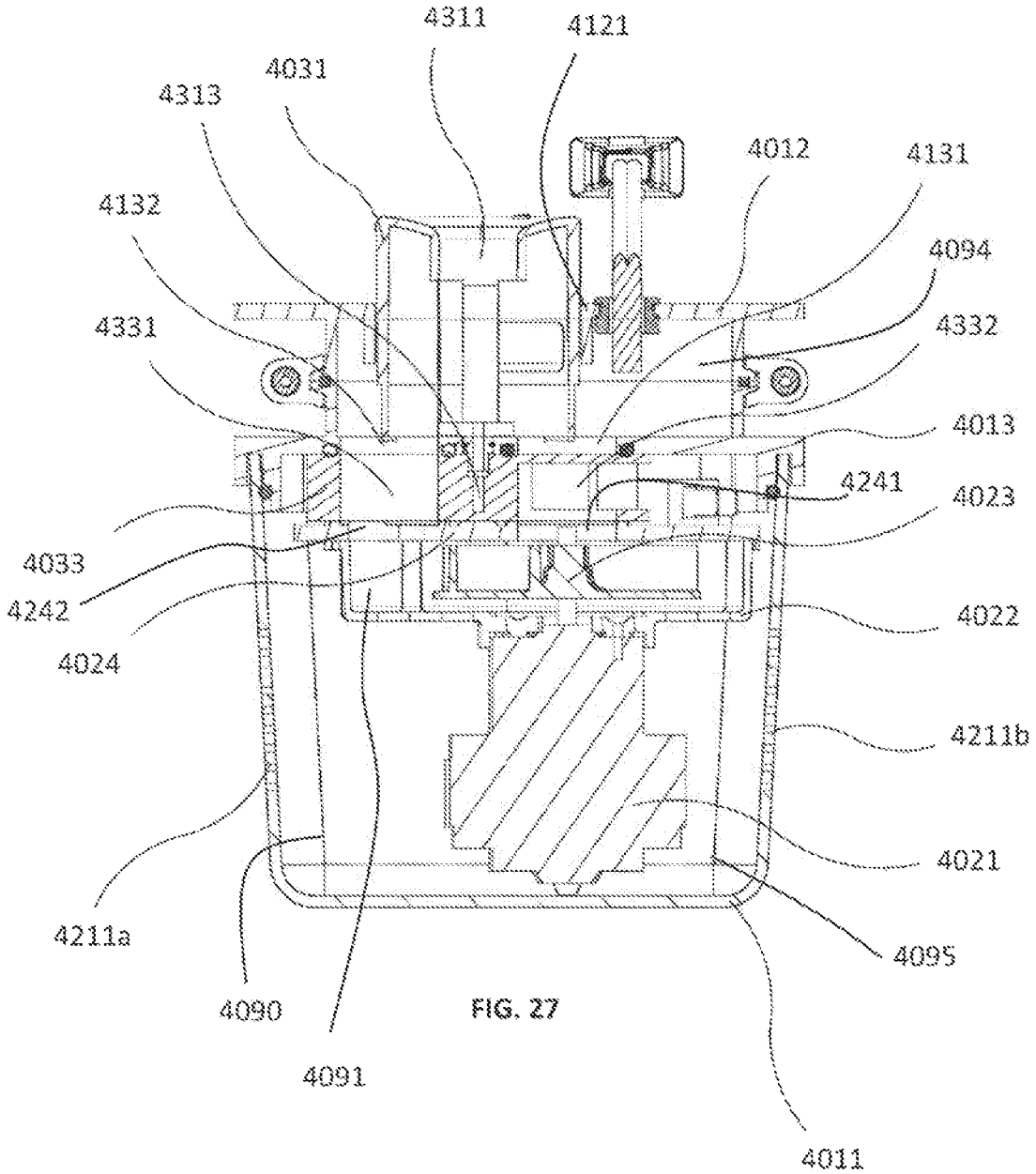
FIG. 27 illustrates a cross section view of the air assembly of FIG. 26, taken along the H-H line, illustrating the interior of the exemplary air assembly.
Figure 28:
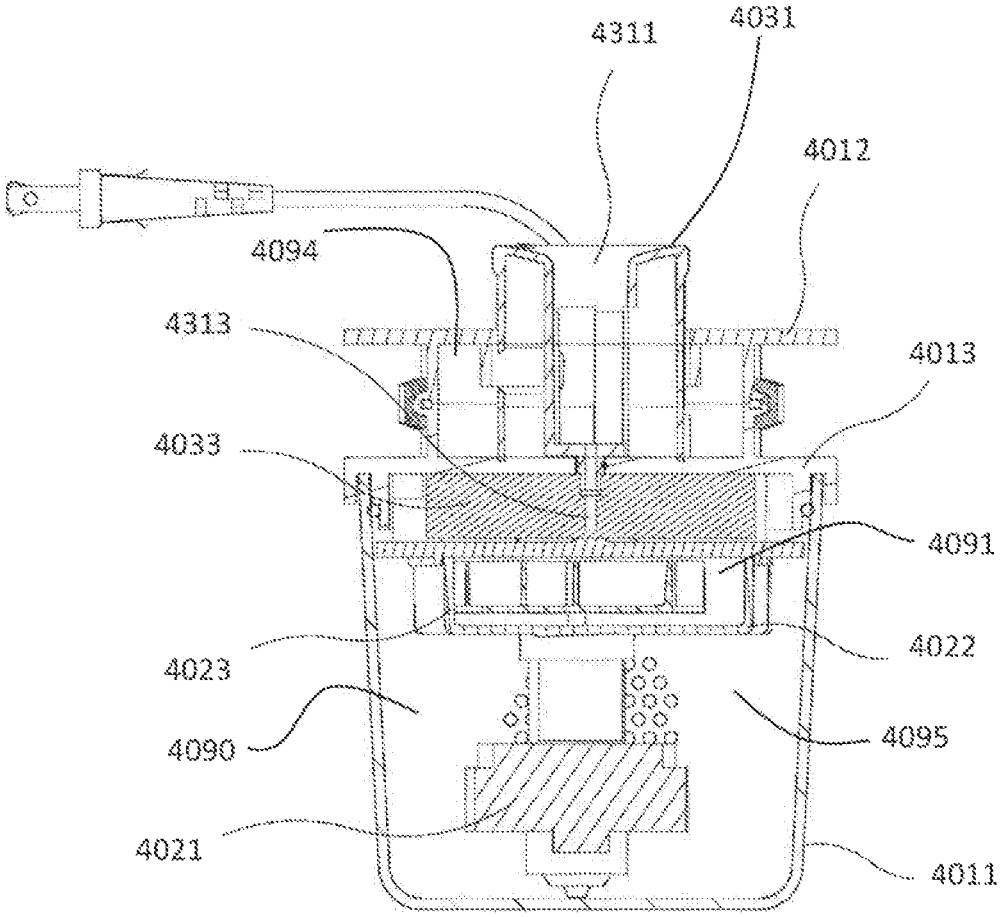
FIG. 28 illustrates a cross section view of the air assembly of FIG. 26, taken along the G-G line, illustrating the interior of the exemplary air assembly from another view.
Figure 29:
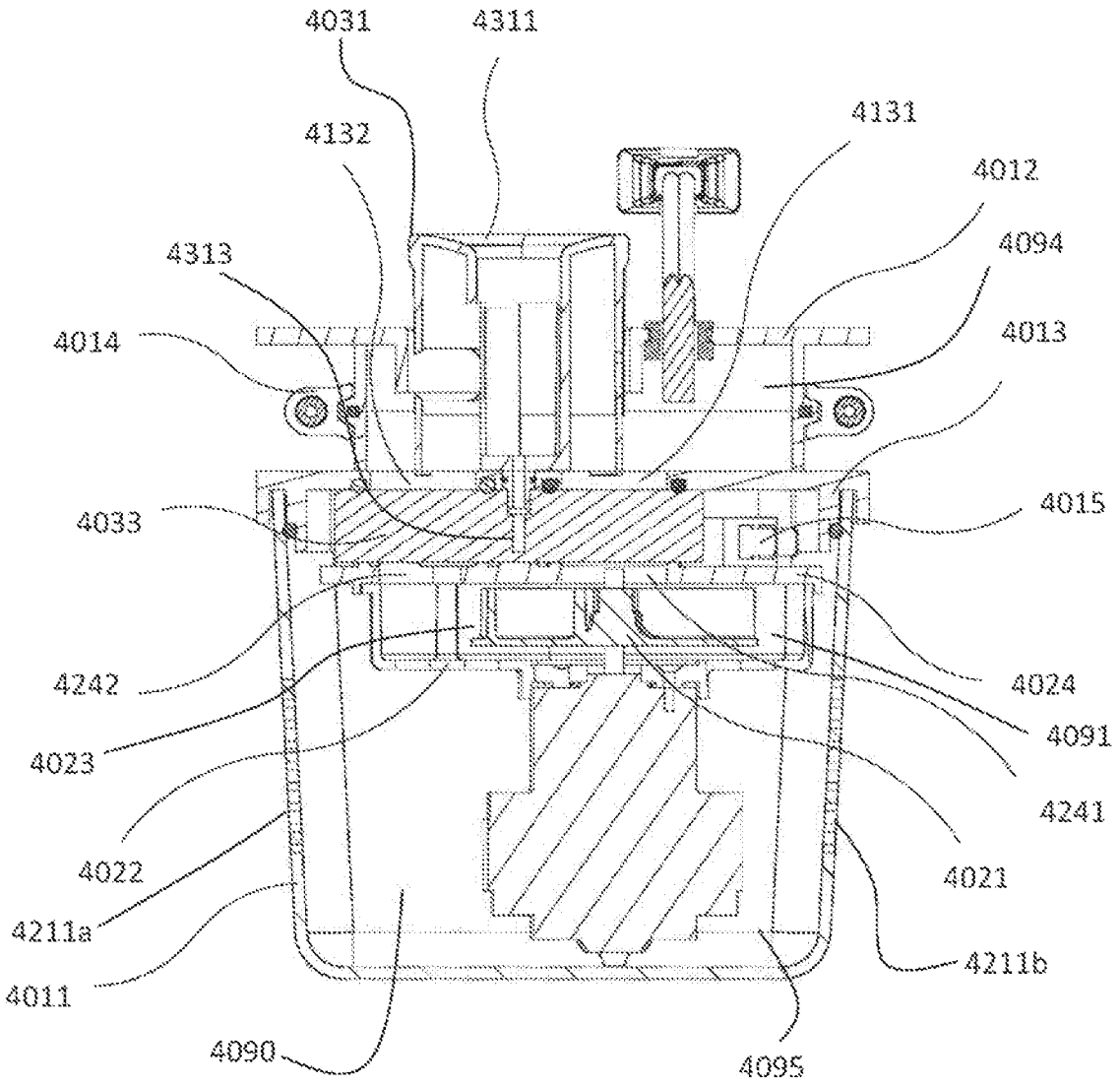
FIG. 29 illustrates a cross section view of the air assembly of FIG. 24, illustrating the interior of the exemplary air assembly when the air assembly is in a closed state.
Figure 31:
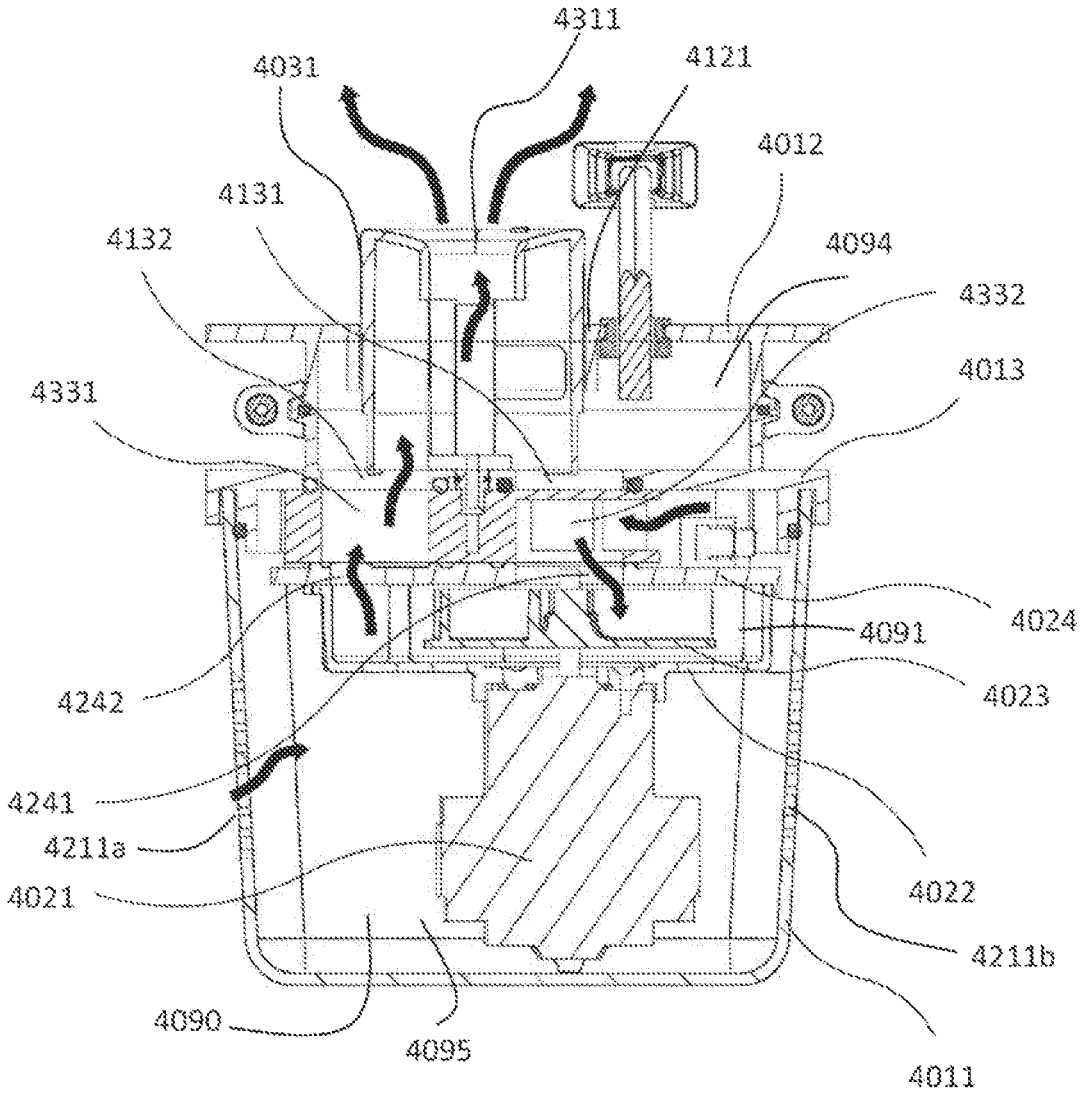
FIG. 31 illustrates a cross section view of the air assembly of FIG. 24 in a deflation state, illustrating the path of air flow through the air assembly during deflation of an inflatable product.

In a second position as illustrated by FIGS. 27 and 31, the first vent 4331 is in selective communication with the wheel vent 4311 of the hand wheel 4031 via the deflation vent 4132 of the panel 4013 and the air outlet 4242 of the pump cover 4024. When the first vent 4331 of the rotating disc 4033 is in this position, the second vent 4332 of the rotating disc 4033 is in selective communication with the air inlet 4241 of the pump cover 4024 and the inflation/deflation ports 4211*a-b* of the main body 4011. This configuration of air assembly 4000 may also be referred to as the deflation state.

When the user rotates the hand wheel 4031 in a second direction to the deflation state as illustrated by FIG. 31, the rotating disc 4033 rotates with the hand wheel 4031 so that the other sensed protrusion 4335 touches the microswitch 4015 (FIG. 24) and starts the motor 4021. Additionally, the first vent 4331 comes into the second position described above. The motor 4021 drives the impeller 4023 to rotate, drawing air from the inflatable product P (FIG. 24A) into the second chamber 4095 via the inflation/deflation ports 4211*a-b*. Next, the air moves through the second vent 4332 of the rotating disc 4033 and the air inlet 4241 of the pump cover 4024 to enter the impeller chamber 4091. The air then exits the impeller chamber 4091 into the first chamber 4094 through the air outlet 4242 of the pump cover 4024, the first vent 4331 of the rotating disc 4033, and the deflation vent 4132 of the panel 4013. From the first chamber 4094, the air is free to exit into the surrounding environment via the wheel vent 4311 of the hand wheel 4031, thus deflating the inflatable product P. When the inflatable product P (FIG. 24A) has been deflated entirely or to a desired pressure, the user may return the hand wheel 4031 to the closed state (FIG. 29) so that the rotating disc 4033 has closed the air inlet 4241 and the air outlet 4242 of the pump cover 4024, and the motor 4021 stops operating as described above.

Now referring generally to FIGS. 32-38, another embodiment of air assembly 5000 is disclosed. The air assembly 5000 has substantially the same structure and operation as the air assembly 1000, except as described below. Like elements of the air assembly 5000 are identified by adding "4000" to the corresponding reference number of the air assembly 1000.

Figure 32:
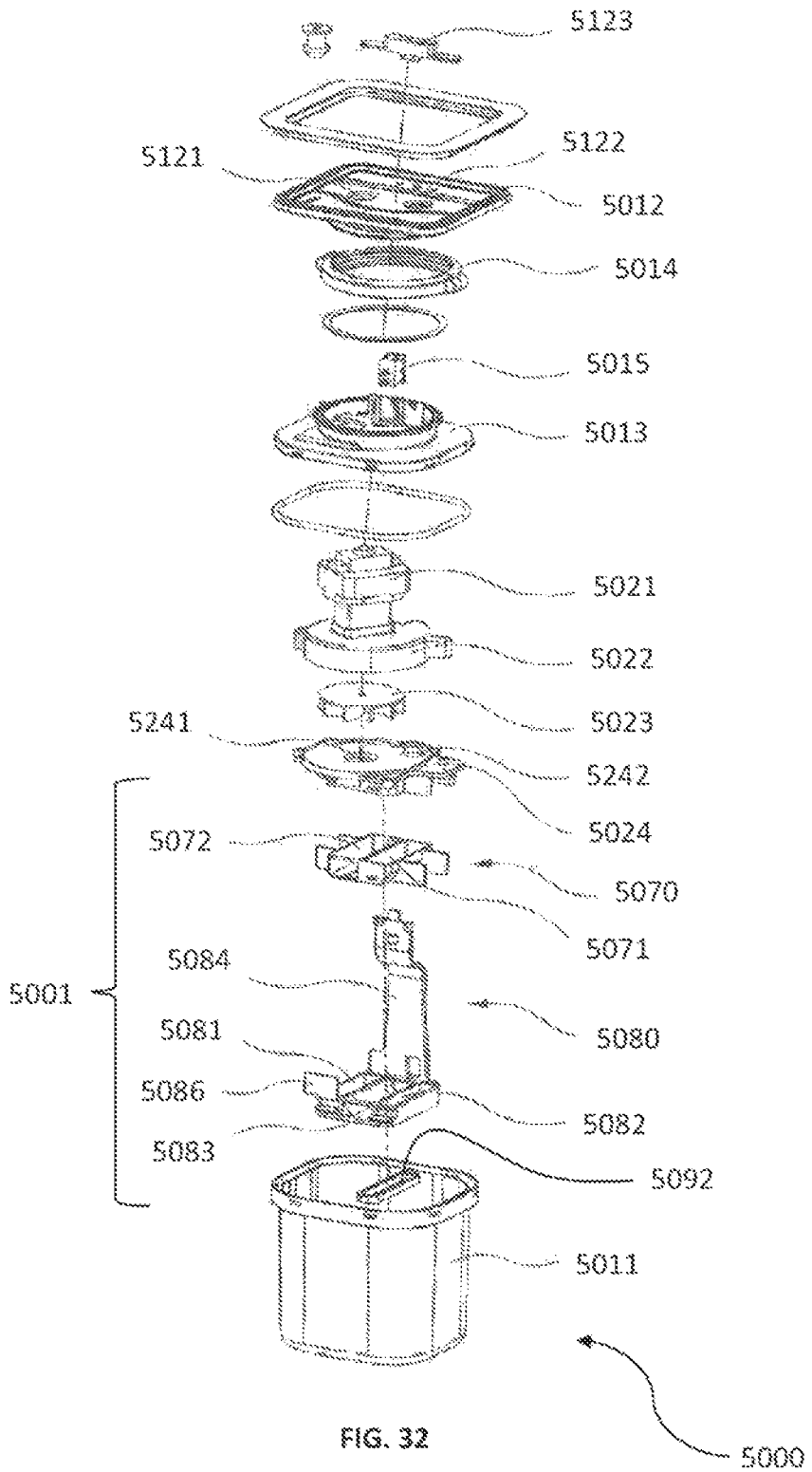
FIG. 32 illustrates an exploded, perspective view of a fifth exemplary air assembly, including a main body, a control panel, and a translating directional control valve.
Figure 33:
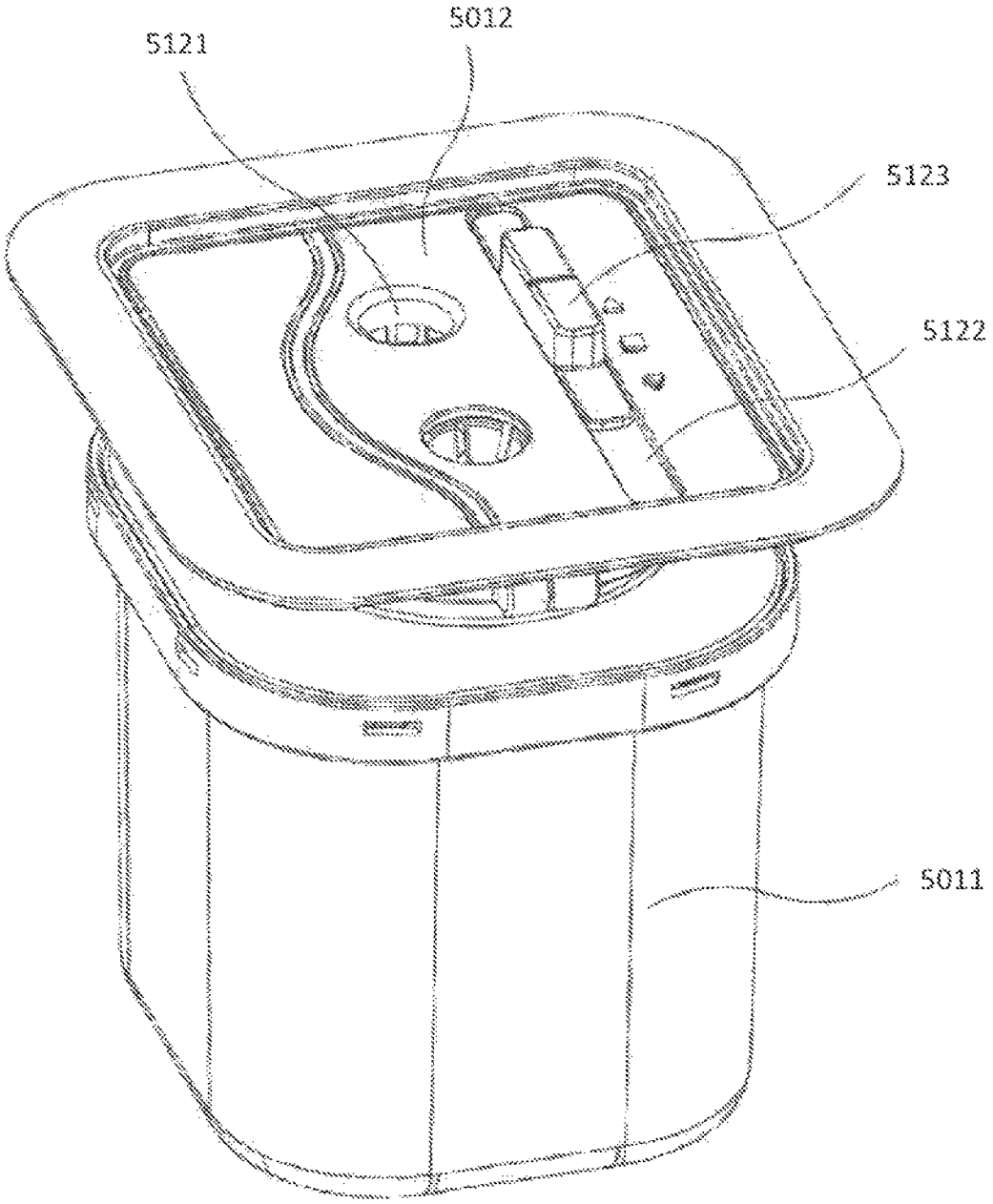
FIG. 33 illustrates a perspective view of the air assembly of FIG. 32, illustrating the exterior structure and the control panel of the exemplary air assembly.

Now referring to FIG. 32-33, like previous embodiments, air assembly 5000 includes a main body 5011 that forms a main body chamber 5090 with an opening, a panel 5013 covering the opening, and a control panel 5012 removably coupled with the main body 5011 via a removeable fixing ring 5014. However, unlike the previous embodiments, the control panel 5012 includes an elongated groove 5122 and a translating actuator button 5123 for operation by the user.

Referring specifically to FIG. 32, air assembly 5000 includes a translating directional control valve assembly 5001 disposed within the main body chamber 5090 and movably positioned between the pump cover 5024 and the main body 5011 so that the inflation/deflation vent or port 5111 located on a lower end of the main body 5011 is in selective communication with the air inlet 5241 or the air outlet 5242 of the pump cover 5024. The translating valve assembly 5001 includes an upper vane 5070 coupled to a lower end of the pump cover 5024 in an airtight manner, and a lower translating vane 5080 disposed between the upper vane 5070 and the main body 5011 so that lower translating vane 5080 is movable side-to-side relative to the upper vane 5070. In other embodiments, the upper vane 5070 may be integrated with the pump cover 5024 or otherwise omitted.

Figure 34:
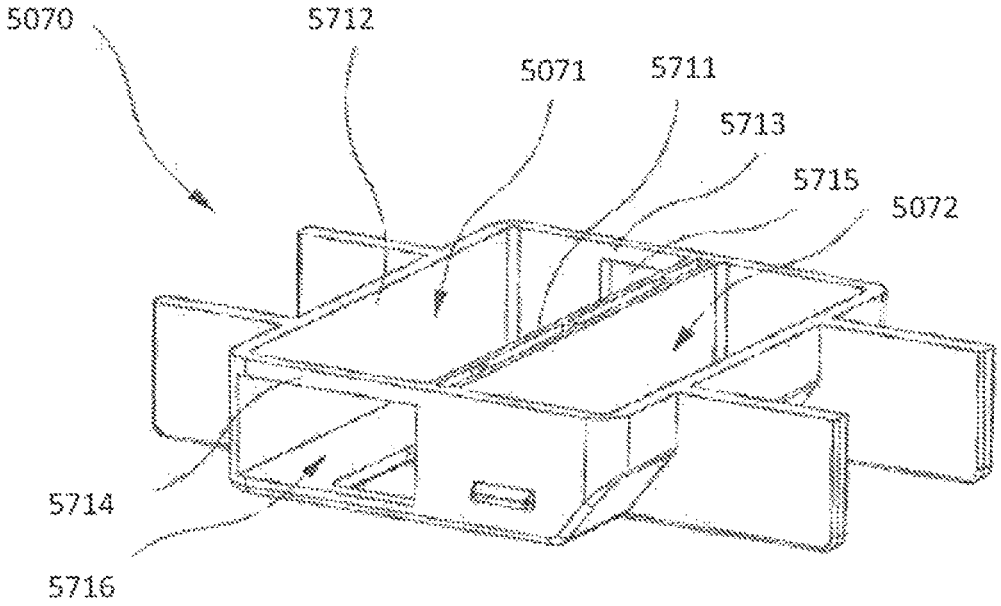
FIG. 34 illustrates a perspective view of an upper vane of the exemplary air assembly of FIG. 32.

Now referring to FIG. 34, the upper vane 5070 is provided with an inlet vent 5071 in communication with the air inlet 5241 of the pump cover 5024 (FIG. 32) and an outlet vent 5072 in communication with the air outlet 5242 of the pump cover 5024 (FIG. 32). The inlet vent 5071 is formed by a first, inner sidewall 5711, located closest to the outlet vent 5072, a second, outer sidewall 5712 parallel to the first sidewall 5711, a third sidewall 5713 between first sidewall 5711 and second sidewall 5712 with an opening 5715 in communication with the main body chamber 5090 (FIG. 36), and a fourth sidewall 5714 parallel to the third sidewall 5713 with an opening 5716 in communication with the main body chamber 5090 (FIG. 36).

Figure 32A:
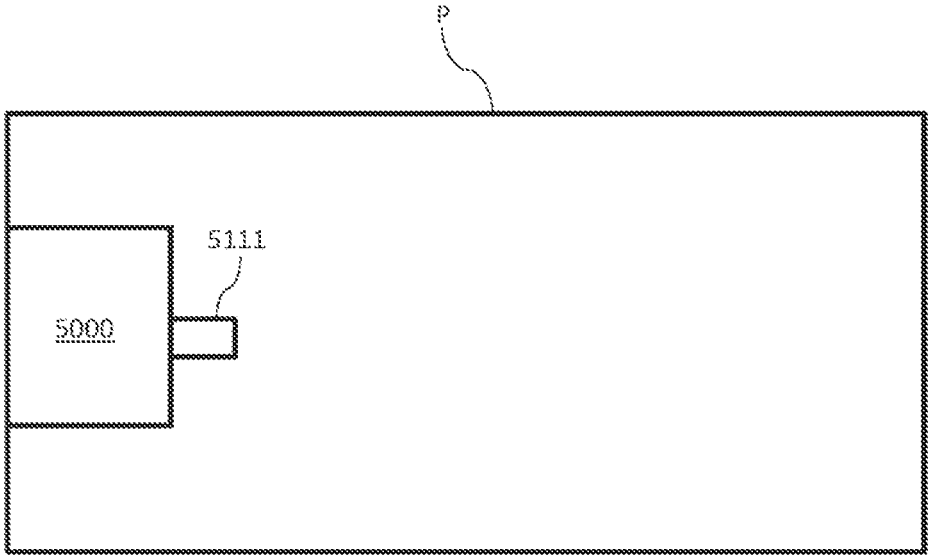
FIG. 32A illustrates a schematic view of the air assembly of FIG. 32 built into an inflatable product.
Figure 35:
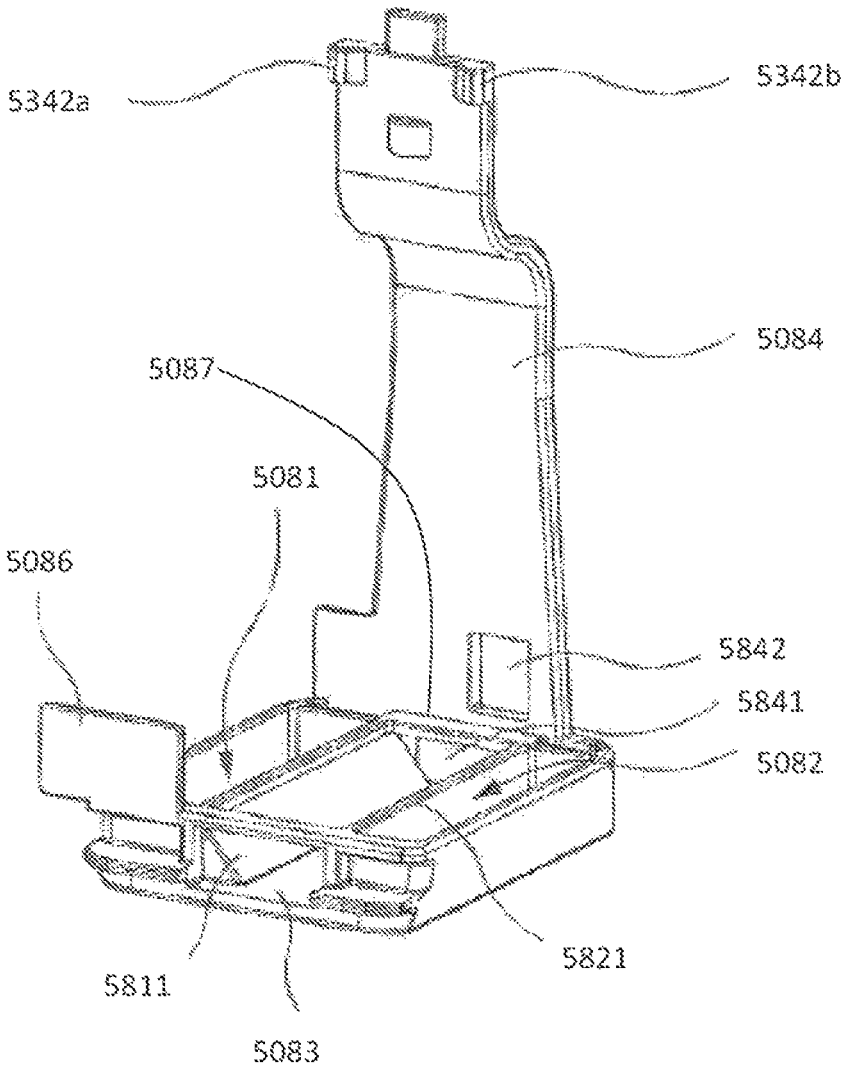
FIG. 35 illustrates a perspective view of a lower translating vane of the exemplary air assembly of FIG. 32.
Figure 36:
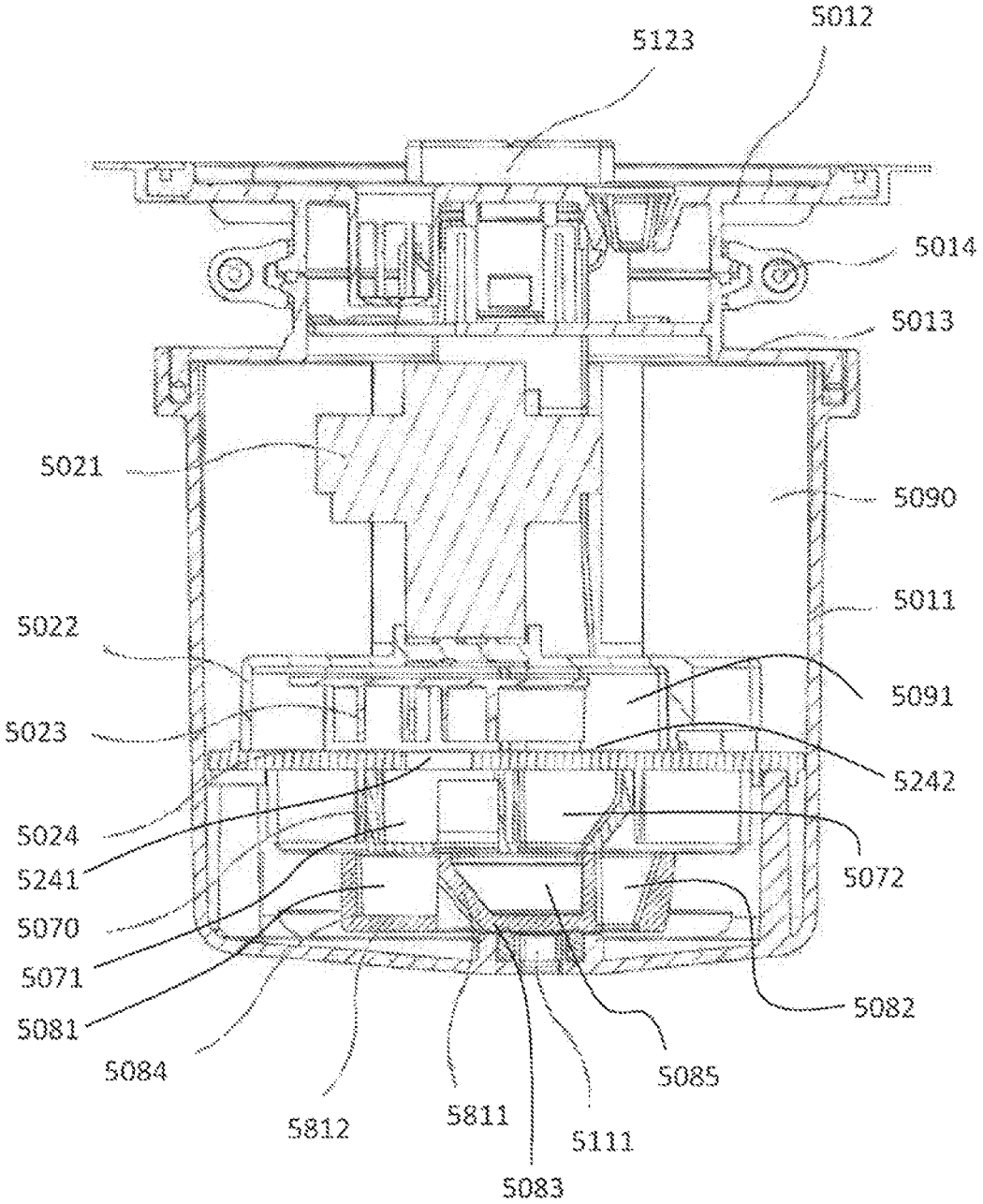
FIG. 36 illustrates a cross section view of the air assembly of FIG. 32, illustrating the interior of the exemplary air assembly when the air assembly is in a closed state.

Now referring to FIGS. 35 and 36, the lower translating vane 5080 is provided with an inlet vent 5081, an outlet vent 5082, and a baffle 5083 disposed between the inlet vent 5081 and the outlet vent 5082. The inlet vent 5081 is formed by a plurality of sidewalls, including a tilted sidewall 5811 closest to the baffle 5083 and a bottom sidewall 5812. An opening formed between a lower end of the tilted sidewall 5811 and the bottom sidewall 5812 is a lower port of the inlet vent 5081, which complements the inflation/deflation port 5111 of the main body 5011 to selectively communicate with the inflation/deflation port 5111 of the main body 5011 (FIG. 36). A gasket 5092 (FIG. 32) is fitted between the lower translating vane 5080 and the inflation/deflation port 5111 to prevent the leakage of air before and after inflation or deflation of the inflatable product P (FIG. 32A). The outlet vent 5082 of the lower translating vane 5080 is also formed by a plurality of sidewalls, including a first vertical sidewall 5821, which is closest to the baffle 5083. A perimeter of the outlet vent 5082 decreases in size gradually from top to bottom so that the bottom end of the outlet vent 5082 complements the inflation/deflation port 5111 of the main body 5011 (FIG. 36) to selectively communicate with the inflation/deflation port 5111 (FIG. 36). One end of the baffle 5083 is coupled to a lower end of the tilted sidewall 5811 of the inlet vent 5081, while the other end of the baffle 5083 is coupled to a lower end of the first sidewall 5821 of the outlet vent 5082. The baffle 5083, the tilted sidewall 5811 of the inlet vent 5081, and the first sidewall 5821 of the outlet vent 5082 cooperate to form a first interior chamber 5085, which is in communication with the main body chamber 5090 (FIG. 36).

Still referring to FIG. 35, the lower translating vane 5080 further includes a transmission member in the form of an actuator arm 5084 that extends vertically from a sidewall 5087 of the lower translating vane 5080, where the sidewall 5087 is comprised collectively of a sidewall of the inlet vent 5081, a sidewall of the outlet vent 5082, and a sidewall of the baffle 5083. The actuator arm 5084 is generally S-shaped to accommodate the motor 5021 (FIG. 32). An upper end of the actuator arm 5084 extends through a clearance hole in the panel 5013 and through the groove 5122 of the control panel 5012 to couple with actuator button 5123, so that a user may change the position of the lower translating vane 5080 via the actuator button 5123 and the actuator arm 5084 (FIG. 33). The actuator arm 5084 also includes two sensed protrusions 5342*a-b* located at a position above the panel 5013 (FIG. 32), so that the protrusions 5342*a-b* can touch the microswitch 5015 supported by the panel 5013 to operate the motor 5021 at direction of the user (FIG. 32).

The actuator arm 5084 further includes a first, lower opening 5841 disposed at a lower portion of the actuator arm 5084 and the adjacent sidewall 5087 and in communication with the first chamber 5085 so that first chamber 5085 is in communication with the main body chamber 5090 (FIG. 36) via the opening 5841. The actuator arm 5084 also includes a second, upper opening 5842 disposed at the lower portion of the actuator arm 5084 and in communication with the opening 5715 on the third sidewall 5713 of the inlet vent 5071 of the upper vane 5070 (FIG. 34) so that the first chamber 5085 is in communication with the main body chamber 5090 (FIG. 36) via the opening 5842 and the opening 5715 on the third sidewall 5713 of the inlet vent 5071 of the upper vane 5070 (FIG. 34).

Continuing to refer to FIG. 35, the lower translating vane 5080 further includes a guide arm 5086, coupled to the sidewall of the inlet vent 5081 opposite from the actuator arm 5084. When the inlet vent 5081 of the lower translating vane 5080 is in selective communication with the inlet vent 5071 of the upper vane 5070 (FIGS. 34 and 38), the guide arm 5086 can close the opening 5716 on the fourth sidewall 5714 of the inlet vent 5071 of the upper vane 5070 (FIG. 34). At the same time, the actuator arm 5084 seals the opening 5715 on the third sidewall 5713 of the inlet vent 5071 of the upper vane 5070 to ensure the air tightness of the inlet vent 5071 of the upper vane 5070 (FIG. 34). Additionally, the guide arm 5086 may cooperate with the actuator arm 5084 to clamp the upper vane 5070 (FIG. 34) to effectively guide the movement of the lower translating vane 5080.

Now referring to FIG. 33, the actuator button 5123 allows the user to adjust the air assembly 5000 between an inflation state, a deflation state, and a closed state. Illustratively, the closed state is located between the inflation state and the deflation state. When the air assembly 5000 is not in use, the actuator button 5123 remains in a closed state (FIG. 36) so that the inflation/deflation port 5111 of the main body 5011 is closed, with the gasket 5092 (FIG. 32) creating an air-tight seal between the lower translating vane 5080 and the inflation/deflation port 5111.

Figure 37:
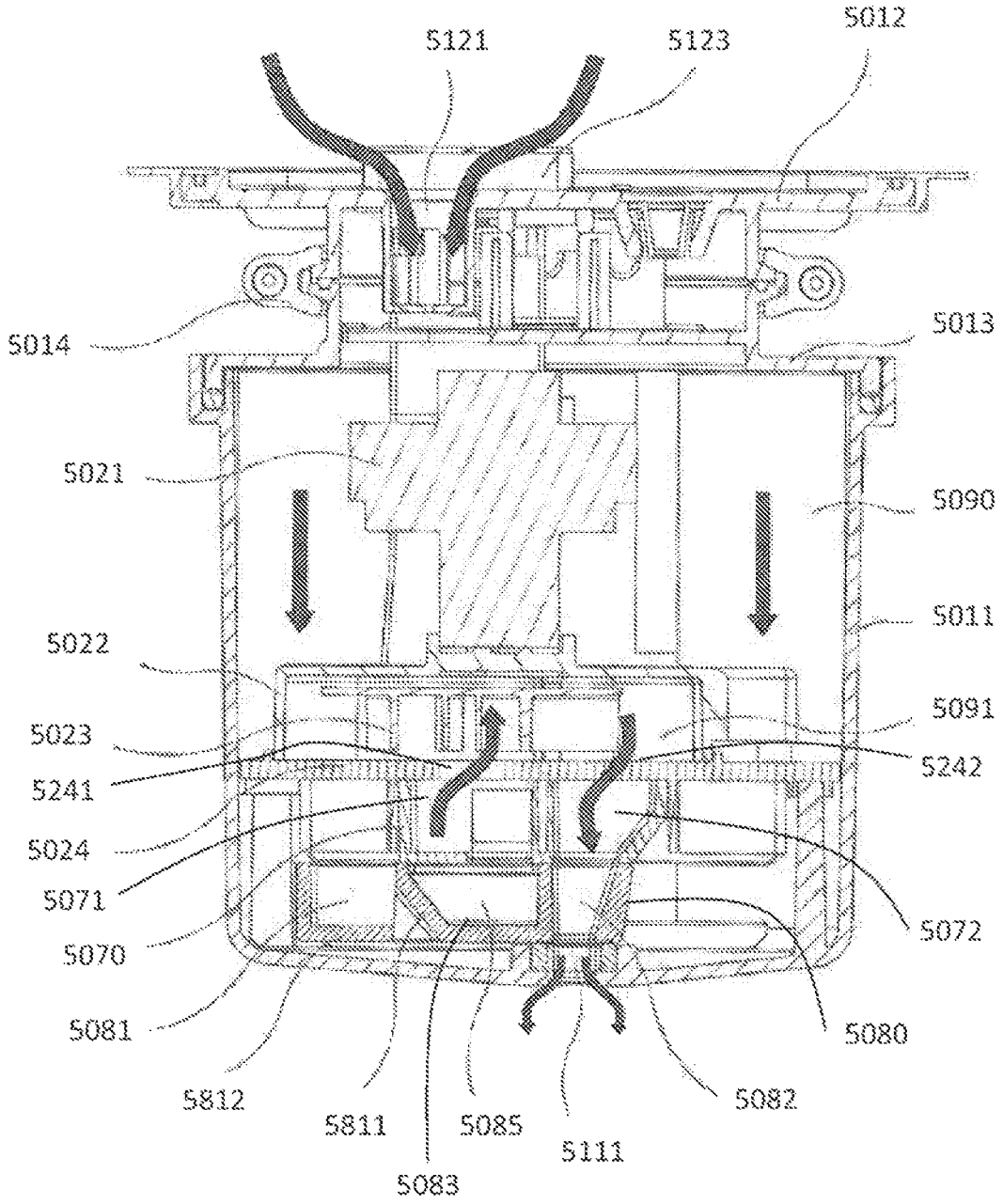
FIG. 37 illustrates a cross section view of the air assembly of FIG. 32 in an inflation state, illustrating the path of air flow through the air assembly during inflation of an inflatable product.

Referring specifically to FIG. 37, the user may begin the inflation state by moving the actuator button 5123 to the left. When the actuator button 5123 is moved, the actuator arm 5084 moves in the same direction, driving the lower translating vane 5080 to also move in the same direction so that the first chamber 5085 on the lower translating vane 5080 is placed into communication with the inlet vent 5071 of the upper vane 5070, an upper end of the outlet vent 5082 of the lower translating vane 5080 is in selective communication with the outlet vent 5072 of the upper vane 5070, and a lower end of the outlet vent 5082 of the lower translating vane 5080 is in selective communication with the inflation/deflation port 5111 of the main body 5011. Additionally, when the actuator arm 5084 moves, protrusion 5342*a* (FIG. 35) touches the microswitch 5015 (FIG. 32) to start the motor 5021. The motor 5021 drives the impeller 5023 to rotate, drawing ambient air from outside of the air assembly 5000 into the main body chamber 5090 through the vent 5121 on the control panel 5012. Next, the air moves through the first chamber 5085, the inlet vent 5071 of the upper vane 5070, and the air inlet 5241 of the pump cover 5024 into the impeller chamber 5091. The air then moves through the air outlet 5242 of the pump cover 5024, the outlet vent 5072 of the upper vane 5070, and the outlet vent 5082 of the lower translating vane 5080. The air is then free to pass through the inflation/deflation port 5111 and enter inflatable product P (FIG. 32A), thus inflating the inflatable product P. When the inflatable product P (FIG. 32A) has been inflated to a desired pressure, the user may return the actuator button 5123 to the closed state (FIG. 36), thereby closing the inflation/deflation port 5111 of the main body 5011, and the motor 4021 stops operating as described above.

Figure 38:
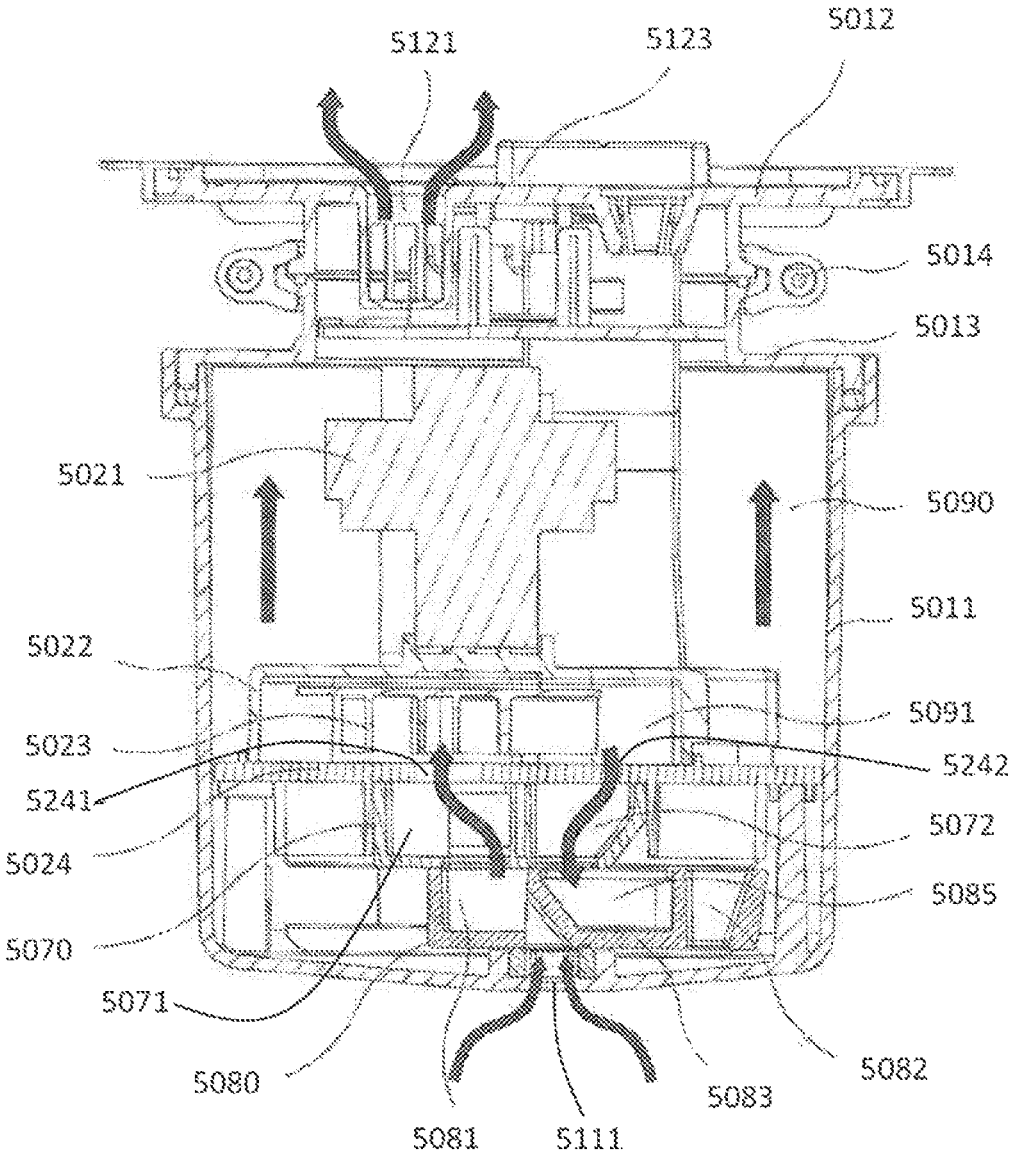
FIG. 38 illustrates a cross section view of the air assembly of FIG. 32 in a deflation state, illustrating the path of air flow through the air assembly during deflation of an inflatable product.

Now referring specifically to FIG. 38, the user may begin the deflation state by moving the actuator button 5123 to the right. When the actuator button 5123 is moved, the actuator arm 5084 moves in the same direction, driving the lower translating vane 5080 to also move in the same direction so that the lower end of the inlet vent 5081 of the lower translating vane 5080 is in selective communication with the inflation/deflation port 5111 of the main body 5011, an upper end of the inlet vent 5081 of the lower translating vane 5080 is in selective communication with the inlet vent 5071 of the upper vane 5070, and the first chamber 5085 on the lower translating vane 5080 is in selective communication with the outlet vent 5072 of the upper vane 5070. Additionally, when the actuator arm 5084 moves, the protrusion 5342*b* (FIG. 35) touches the microswitch 5015 (FIG. 32) to start the motor 5021. The motor 5021 drives the impeller 5023 to rotate, drawing air from the inflatable product P (FIG. 32A) through the inflation/deflation port 5111 through the inlet vent 5081 of the lower translating vane 5080, the inlet vent 5071 of the upper vane 5070, and the air inlet 5241 of the pump cover 5024 into the impeller chamber 5091. Next, the air moves through air outlet 5242 of the pump cover 5024 through the outlet vent 5072 of the upper vane 5070 into the first chamber 5085, where the air is free to enter the main body chamber 5090 and finally exit through the vent 5121 of the control panel 5012 into the surrounding environment, thus deflating the inflatable product P. When the inflatable product P (FIG. 32A) has been deflated entirely or to a desired pressure, the user may return the actuator button 5123 to the closed state (FIG. 36), thereby closing the inflation/deflation port 5111 of the main body 5011 and turning off the motor 5021 as described above.

Various features of the above-described air assemblies 1000-5000 may be selectively combined. For example, air assembly 5000 may include multiple ports in addition to inflation/deflation port 5111, such as air assembly 1000 having an air inlet 1111 and an air outlet 1112.

Although the above-described directional control valves 1033, 2043, 3033, 4033, 5001 move by operating the corresponding manual actuators 1031, 2031, 3031, 4031, 5123, it is also within the scope of the present disclosure that the directional control valves 1033, 2043, 3033, 4033, 5001 may be moved by operating electronic actuators.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air assembly for use with an inflatable product, the air assembly comprising:

a main body forming a main body chamber with a vent in communication with the inflatable product;

a control panel coupled to the main body, the control panel comprising a vent in communication with the surrounding environment and the main body chamber;

an actuator disposed on the control panel;

a pump body disposed in the main body chamber;

a pump cover disposed in the main body chamber, the pump cover cooperating with the pump body to form an impeller chamber and including an air inlet and an air outlet in communication with the impeller chamber;

an impeller disposed within the impeller chamber;

a motor disposed within the main body chamber and operably coupled to the impeller, the impeller configured to direct air from the air inlet to the air outlet of the pump cover; and a translating directional control valve disposed within the main body chamber between the vent of the main body and the pump cover, the translating directional control valve comprising a plurality of vents for selective communication with the vent of the main body, the plurality of vents also in selective communication with the air inlet and the air outlet of the pump cover.

2. The air assembly of claim 1, wherein the translating directional control valve further comprises a first vane provided with a first vent to selectively communicate with the air inlet of the pump cover and the vent of the main body, a second vent to selectively communicate with the air outlet of the pump cover and the vent of the main body, and a baffle to selectively close the vent of the main body.

3. The air assembly of claim 2, wherein the first vane further comprises an adjustment arm having a lower end coupled to one side of the first vane and an upper end extending to the control panel and coupled to the actuator.

4. The air assembly of claim 3, further comprising a panel coupled to the main body and supporting a sensor operably coupled to the motor, wherein the adjustment arm comprises at least one sensed protrusion to selectively contact the sensor and activate the motor.

5. The air assembly of claim 3, wherein the translating directional control valve further comprises a stationary second vane disposed between the first vane and the pump cover, the second vane comprising a first vent in communication with the air inlet of the pump cover and a second vent in communication with the air outlet of the pump cover.

6. The air assembly of claim 5, wherein the first vane further comprises a guide arm coupled to the first vane parallel to the adjustment arm to guide movement of the first vane in a direction parallel to the adjustment arm.

7. The air assembly of claim 6, wherein the first vent of the second vane further comprises a first sidewall, a second sidewall parallel to the first sidewall, a third sidewall parallel to a fourth sidewall, and the fourth sidewall comprising an opening in communication with the first vent of the second vane and the main body chamber.

8. The air assembly of claim 7, wherein the third sidewall of the first vent of the second vane further comprises an opening and a lower portion of the adjustment arm comprises an opening to complement the opening of the third sidewall.

9. The air assembly of claim 2, wherein the first vent of the first vane further comprises a tilted sidewall and a bottom sidewall, an opening formed between a lower end of the tilted sidewall and a bottom sidewall comprises a lower port of the first vent to complement the vent of the main body.

10. The air assembly of claim 9, wherein the second vent of the first vane further comprises a first sidewall, a second sidewall, a third sidewall, and a fourth sidewall.

11. The air assembly of claim 10, wherein an end of the baffle is coupled to a lower end of the tilted sidewall of the first vent of the first vane and another end of the baffle is coupled to a lower end of the first sidewall of the second vent of the first vane, and the baffle, the tilted sidewall of the first vent of the first vane, and the first sidewall of the second vent of the first vane cooperate to form a first chamber in communication with the main body chamber.

* * * * *